US006536336B1

(12) United States Patent
Jaenson et al.

(10) Patent No.: US 6,536,336 B1
(45) Date of Patent: Mar. 25, 2003

(54) AUTOMATIC BALE STRAPPING SYSTEM

(76) Inventors: Howard W. Jaenson, 1432 Covinna Hills Rd., Covina, CA (US) 91724; Bradley P. Actis, 6329 Calle Eleante, Rancho Cucamonga, CA (US) 91731

( * ) Notice: Subject to any disclaimer, the term of this patent is extended or adjusted under 35 U.S.C. 154(b) by 0 days.

(21) Appl. No.: 09/493,426

(22) Filed: Jan. 29, 2000

Related U.S. Application Data

(60) Provisional application No. 60/117,795, filed on Jan. 29, 1999.

(51) Int. Cl.[7] ..... B65B 13/20

(52) U.S. Cl. ..... 100/3; 100/10; 100/26; 100/33 PB

(58) Field of Search ..... 100/8, 10, 11, 100/25, 26, 33 PB, 3; 53/589, 590, 529

(56) References Cited

U.S. PATENT DOCUMENTS

| | | | | |
|---|---|---|---|---|
| 321,542 | A | 7/1885 | Sheppard | |
| 872,176 | A | * 11/1907 | Grimes | 100/8 |
| 1,732,619 | A | 10/1929 | Ryan | |
| 1,947,918 | A | 2/1934 | Paxton | |
| 1,955,144 | A | * 4/1934 | Paxton | 100/8 |
| 1,992,536 | A | * 2/1935 | Mattingly | 100/8 |
| 2,612,833 | A | 10/1952 | MacChesney | |
| 2,891,365 | A | * 6/1959 | Heckel | 100/25 |
| 2,937,484 | A | 5/1960 | Wiman | |
| 3,168,912 | A | 2/1965 | Marica | |
| 3,213,780 | A | 10/1965 | Nietzel et al. | |
| 3,279,355 | A | 10/1966 | Missioux | |
| RE26,289 | E | 10/1967 | Neitzel et al. | |
| 3,384,006 | A | * 5/1968 | Helligrath et al. | 100/10 |
| 3,448,680 | A | * 6/1969 | Weber | 100/10 |
| 3,477,363 | A | 11/1969 | Trumbo | |
| 3,718,526 | A | 2/1973 | Annis, Jr. | |
| 3,720,158 | A | 3/1973 | Sauer et al. | |
| 3,767,885 | A | 10/1973 | Fryer | |
| 3,791,420 | A | 2/1974 | Beach | |
| 3,834,297 | A | 9/1974 | Huson | |
| 3,863,297 | A | 2/1975 | Simich | |
| 3,863,558 | A | 2/1975 | Trumbo | |
| 4,055,115 | A | 10/1977 | Simich et al. | |
| 4,062,278 | A | 12/1977 | Cheung | |
| 4,077,313 | A | 3/1978 | Lems et al. | |
| 4,079,667 | A | 3/1978 | Lems et al. | |
| 4,119,449 | A | 10/1978 | Gould et al. | |
| 4,353,295 | A | 10/1982 | Kandarian | |
| 4,378,262 | A | 3/1983 | Annis, Jr. | |
| RE31,353 | E | 8/1983 | Cheung | |
| 4,466,535 | A | 8/1984 | Huson | |
| 4,479,834 | A | 10/1984 | Kobiella | |
| 4,484,518 | A | 11/1984 | Jaenson | |
| 4,533,343 | A | 8/1985 | Kobiella | |
| 4,572,419 | A | 2/1986 | Klaus et al. | |

(List continued on next page.)

*Primary Examiner*—Stephen F. Gerrity
(74) *Attorney, Agent, or Firm*—Christie, Parker & Hale, LLP

(57) ABSTRACT

An automatic bale strapping device is mounted on a baling press and is configured to present overlapping lengths of flexible thermoplastic strapping for welding in a region corresponding to either the top or bottom of a compressed bale. Baling straps are precut to a predetermined length and preloaded into the device while the press ram is still operating. Articulated strap tying assemblies are mounted to either side of the press and include locks which grip opposing ends of the precut baling strap. The strap tying assemblies rotate around the compressed bale so as to direct the baling strap circumferentially around the bale and articulate to bring the opposite ends of the baling strap into an overlapping relationship for welding while the press is still forming the bale. The straps are gripped tightly within the locks in order to wrap the strap tightly around a bale, but a short welding portion of each strap is free-floating in order to allow sufficient movement for friction welding.

23 Claims, 18 Drawing Sheets

U.S. PATENT DOCUMENTS 4,661,185 A 4/1987 Kobiella
4,663,915 A 5/1987 Van Erden et al.
4,683,017 A 7/1987 Figiel et al.
4,707,390 A 11/1987 Cheung
4,776,905 A 10/1988 Cheung et al.
4,791,968 A 12/1988 Pearson
4,903,371 A * 2/1990 Villemin ..... 53/590
4,951,562 A 8/1990 Ribaldo
4,952,271 A 8/1990 Cheung et al.
4,953,599 A 9/1990 Kato
4,960,968 A 10/1990 Kusakabe et al.
5,006,385 A 4/1991 Cheung et al.
5,024,149 A 6/1991 Kato
5,078,185 A 1/1992 Angarola
5,087,306 A 2/1992 Cheung et al.
5,238,521 A 8/1993 Cheung et al.
5,267,508 A 12/1993 Yoshino
5,306,383 A 4/1994 Kobiella
5,348,781 A 9/1994 Kobiella
5,350,472 A 9/1994 Kobiella
5,377,477 A 1/1995 Haberstroh et al.
5,379,687 A * 1/1995 Moseley ..... 100/26
5,400,706 A 3/1995 Tipton et al.
5,546,855 A 8/1996 Van Doorn et al.
5,644,978 A 7/1997 Jaenson et al.
5,673,614 A 10/1997 Jaenson et al.

* cited by examiner

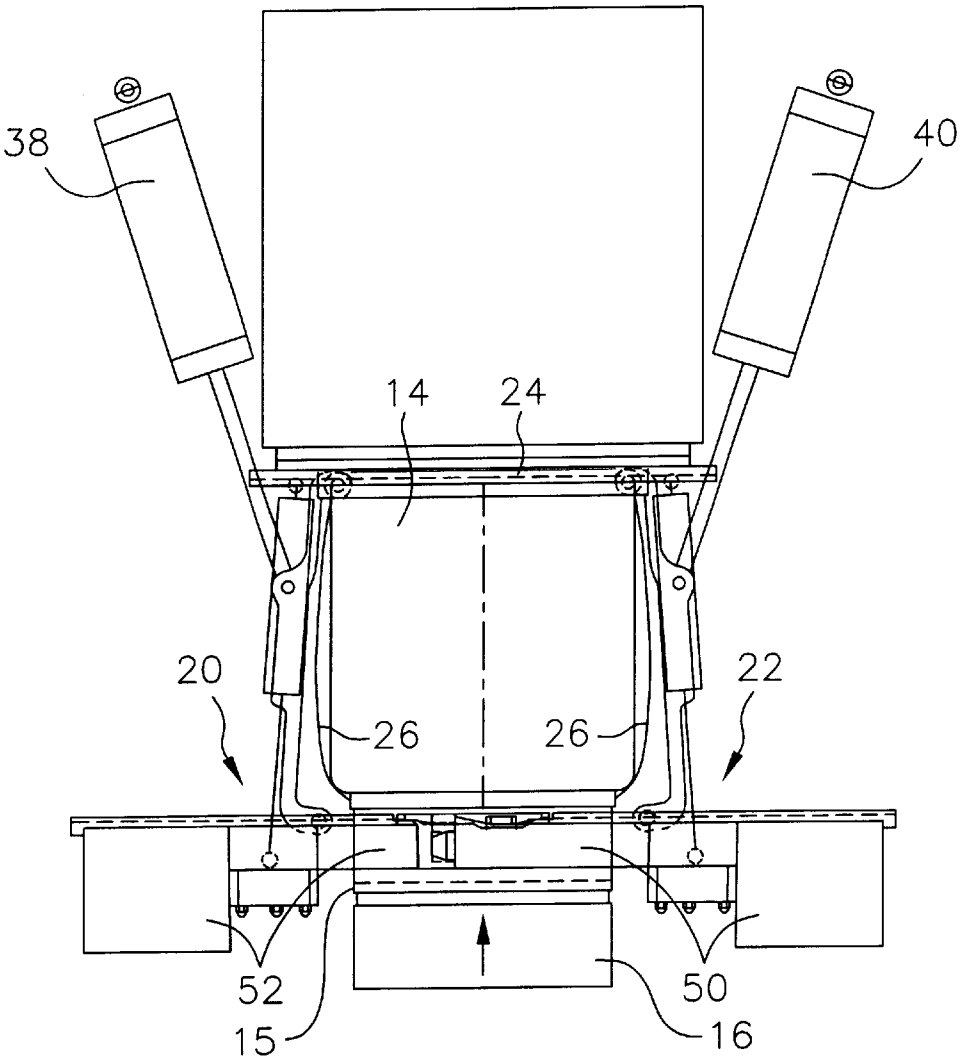
FIG. 9
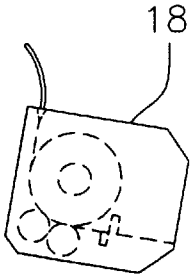

AUTOMATIC BALE STRAPPING SYSTEM

CROSS-REFERENCE TO RELATED APPLICATION(S)

The present application is related to provisional patent application Serial No. 60/117,795, filed Jan. 29, 1999, entitled AUTOMATIC BALE STRAPPING SYSTEM, commonly owned by the assignee of the present invention, the entire disclosure of which is expressly incorporated herein by reference.

FIELD OF THE INVENTION

The invention relates to an apparatus and method useful for automatically tying bales of cotton or other fibers, and in particular, to an automatic bale tying apparatus for tying a plurality of plastic straps around a bale while reducing the stresses at the joint of the baling strap material.

BACKGROUND OF THE INVENTION

In the cotton industry, the normal method of banding or tying cotton bales has been to have workmen direct a tie, such as a band or wire, around a bale and then secure the ends of the ties appropriately depending on the design of the tie. In the cotton or fiber industry, there are generally three ways in which to secure a bale after a bale has been pressed. Pertinent securing means include pre-formed steel wires that have interlocking ends pre-formed into loops which engage one another during the tying operation, flat ribbon-steel bands which have their ends inserted into a crimp by which they are secured, and flat thermoplastic strapping material, typically polyethylene or polyester.

Steel pre-formed wires have a loop manufactured into each end which are interlocked around a bale forming a square knot. When the pressure is released from the bale, the knot formed by the interlocking loops pulls tight and retains the bale against This paper or fee is being deposited with the further expansion. In a conventional bale-tying operation, two workmen (one on each side of the baling press) manually bend the wires around the bale and secure the ends of the wires together in a wire tie guide assembly. The wires are normally tied together sequentially, one at a time. Alternatively, wires might be tied in a hydraulically operated wire tying device for mounting on a baling press, which ties a plurality of wires having pre-formed interlocking ends around a bale formed in the press. Pivotally mounted wire bend assemblies take the place of workmen on each side of the baling press, and bend the tie wires around a bale by inserting the ends of the tie wires into a wire tie guide assembly. However, workmen are still required to individually load each of a plurality of tie wires into the wire bend assemblies.

Although an improvement over the manual-type bale tying operation, a hydraulically operated wire tying device still exhibits certain problems which slow the ginning process. Exact timing is required for the sequence of events which make up a wire tying operation. If a wire does not follow the correct path at the correct time, several factors can combine to prevent the interlocking ends of the wire from engaging in a knot. In particular, the interlocking ends of the wires are conventionally oriented such that the loops are disposed in the generally horizontal plane. This geometric orientation forces the wire closers to be constructed with relatively wide cavities, in order to accommodate the wide aspect ratios of the loops. This, in turn, allows the wires a greater degree of freedom of movement within the cavities.

Consequently, there is a greater probability of one wire merely sliding past another, without their loops engaging in a knot.

In addition, press wear, both alone or in combination with component manufacturing tolerances, can cause a follow block to vary its position or orientation both vertically or from side to side. Consequently, the wire bend assemblies may not be in alignment with a wire tie guide assemblies. All the above-described cases result in mis-ties, with a consequent loss of time and possible damage to the press.

Bale tying using flat steel straps is hindered primarily by the cost of the strapping material, the complexity of the machinery used, and the speed at which the machinery is able to operate. In addition, the sheer weight of steel strap tie material and its substantially sharp edges, makes it cumbersome and particularly dangerous to handle. Further, once it is removed from a bale, steel strapping material is not easily recycled by an end user. Removal is difficult and, once removed, a large volume of sharp material must be colleted and crushed together to form it into a package that can be more easily handled. Notwithstanding the foregoing, steel strap tie material is further disadvantageous in that its weakest spot (the joint) is located in the highest stress position on the bale, because the forming machinery is only able to apply a joint (crimp) on the side of the bale, i.e. the bale position with the highest degree of lateral pressure or stress. This results in significant tie breakage with a consequent loss of bale integrity.

Conversely, plastic or non-ferrous strapping is an ideal material for strapping bales of cotton or other fibers. Plastic is relatively light in weight and can be formed into a variety of widths and thicknesses, and with soft edges, which allows easy handling and lowers shipping costs. Plastic or non-ferrous strapping material is very competitive with wire ties, on a cost per bale basis, and is easily adaptable to fully automatic tying machinery. Plastic or non-ferrous strapping material is readily recyclable by the end user and is considered substantially safer than steel strapping material, particularly in instances of strap breakage.

Because of the particular orientation of conventional plastic strap automatic tying machinery, certain disadvantages arise when one adapts strapping and joint forming apparatus to the structure of a baling press. Typically, automated thermoplastic strapping machinery, including a material feeder, tensioner, cutting shear and joint former, are so large that they are precluded from being able to be placed anywhere except on the side of the bale. As was the case with steel strapping material discussed above, thermoplastic strapping joint formation takes place in the region of the bale that exhibits the highest degree of tension stress.

In this regard, conventional thermoplastic strapping machinery must typically wait until a baling press has completed operation and has reached "shut height", before it begins the strapping operation. The strapping head pulls strapping material off of a spool and directs it around the bale through a series of shoots, until the front edge of the strapping material has completed its circuit of the bale and is directed back to the region of the strapping head. The strap is then pulled tight around the bale to a pre-determined tension and the strap is then cut with a shear. The two ends are then joined by a friction weld, hot knife weld, or other similar joint forming operation, and maintained together until the joint is cool, in which time the strap is released and allowed to carry the tension load of the bale.

Referring now to FIGS. 1*a*, 1*b* and 1*c*, there is shown a semi-schematic view of cotton, or other fibers, being pressed into a bale between the platens of a hydraulic press in accord with the prior art. Typically, fiber is pressed by a large hydraulic cylinder out of a box that measures approximately 30 inches wide by 54 inches long and 144 inches deep. Such a box is typically filled with approximately 500 pounds of cotton lint which is subsequently pressed into a 20 inch by 54 inch bale measuring approximately 20 to 22 inches tall (in accordance with the illustration of FIG. 1*a*). The box from which the bale is pressed has been omitted for the sake of illustrational clarity.

Strapping material, in the form of thermoplastic straps, are inserted through guide slots in the upper and lower platens, and are secured on the sides of the bale (as shown in the illustration of FIG. 1*b*). Once the bale is tied, the press is released and the bale is free to expand to the constraints of the straps. As shown in the illustrated embodiment of FIG. 1*c*, the bale is then dumped out of the press, making way for a subsequent box loaded with an additional 500 pounds of cotton lint for pressing into the next bale.

It should be noted that conventional thermoplastic strapping systems typically consist of three laterally spaced-apart strapping heads, such that the unit must be indexed in order to tie the requisite number of straps (typically 6) about a bale. Should the baling press leak down slightly (a typical artifact of cotton presses) the compressed bale would tend to grow as the press platens separated. When an indexing strapper is used, typically the #1, #3 and #5 straps are tied first. Five to ten seconds later, the strapping head is indexed and the #2, #4 and #6 straps are tied. In the event of press leakage, the first three straps are pulled tight around a smaller diameter bale. The second three straps are subsequently pulled tight around a bale that has expanded and are therefore not as tight. This causes the first three straps to be subject to substantially greater pressure than the second set. These ties are more prone to exceed yield strength and fail which typically causes total strap failure as pressure promptly increases for the ties of the second set.

Accordingly, an apparatus (and process) for tying bales with a flexible thermoplastic strapping material, that is designed for efficient, repeatable operation with low joint stress is needed. Such an apparatus should be designed for easy operation by a single workman to reduce labor costs, while at the same time being easy to install or retrofit to existing presses. Such an apparatus should further be mountable to operate in conjunction with a press such that ginning speed is increased by incorporating the tying process into the last few seconds of the bale pressing operation, thus eliminating the separate indexing and tying steps conventionally undertaken at the end of the process.

SUMMARY OF THE INVENTION

The present invention provides for an automatic bale strapping system which is permanently coupled to a baling press and which is loaded with a precut length of strapping material and which deploys for the tying operation while the press ram is still moving. In one aspect of the invention, first and second arm assemblies are pivotally mounted on opposite sides of the baling press and which receive and hold the entire length of a precut baling strap. The first and second arm assemblies pivot around a compressed bale as the assemblies rotate from a strap loading position to a welding position. At least one of the first and second arm assemblies include an extension means which protects an otherwise protruding end of the precut baling strap during the pivoting operation. The extension means subsequently retracts to thereby expose the end of the precut baling strap during the welding operation.

A movable follow block is mounted on the bale press ram and is forced against the bale by the press ram in order to compress the bale on the baling chamber. The follow block includes closure cavities which receive the first and second arm assemblies for welding engagement. A friction weld is formed in an interfacial region of overlapping strap ends with the subsequent weld being positioned in a region corresponding to the top or bottom surface of a bale formed in the press. The closure cavity comprises an elongated, open-ended cavity extending across the length of the follow block. The first arm assembly is inserted into a first end of a cavity as the first assembly is pivoted and the second arm assembly is inserted into a second, opposite end of the cavity, as the second assembly is pivoted.

In an additional aspect of the invention, a guide chute is disposed along each of the first and second arm assemblies which guides and retains a length of pre-cut bale strapping material. A feeder assembly is removably disposed at end of the first arm assembly and introduces a length of bale strapping material into the guide chutes of the arm assemblies. Feeder assembly includes a shear for cutting the strapping material to a predetermined length after the strapping is introduced into the device.

In a further aspect of the invention, each arm assembly includes a centrally disposed mounting plate which forms the surface of a baling chamber opposite the follow block. A pivotally movable arm is mounted on an outside edge of a mounting plate and is capable of being pivoted from a longitudinally extending loading position to a downwardly extending weld position. The finger assembly is mounted on the distal end of each arm with each finger assembly able to be pivoted with respect to the arm from a longitudinally extending loading position to a follow block insertion position. Each finger on the first arm assembly is associated with counterpart finger on the second arm assembly. The strapping device is constructed such that when both the arm and the fingers comprising the first and second arm assemblies are in their fully extended loading positions, each strap spans the baling press such that each end of the strap is collocated with an end of a respective finger assembly. The extension means comprises a strap tip protection sled which is slidably mounted on the outboard end of a corresponding finger assembly. The strap tip protection sled extends to cover the exposed strap tip during the pivoting operation and retracts to expose the strap tip during the welding operation. At least one of the finger assemblies includes guide means for guiding a first end of the strap into position in the finger assembly for welding and for guiding a received, opposite strap end into overlapping registration with the first end. The guide means includes a Chicane for bendably displacing the first strap end so as to form a stress relief bow.

In yet a further aspect of the invention, a level arm assembly is coupled between the central mounting plate and each finger assembly. The level arm assembly operates to control the angular position of each finger assembly with respect to the plane of the follow block. The level arm assembly guides each finger assembly into the closure cavity by adjusting the angular position of each finger assembly such that the finger assembly is level with respect to the plane of the follow block for easy insertion.

In summary, the bale strapping device ties thermoplastic straps around a bale which has been compressed into a generally rectangular form. First and second articulated strap tying assemblies are pivotally mounted on opposite sides of a central mounting member of a baling press. The first and second strap tying assemblies are disposed in mirror image fashion and in opposition to each other and are disposed to receive and hold the entire length of a baling strap which has been precut to a predetermined length. First and second finger assemblies are each disposed at a distal end of a respective first and second strap tying assembly. Each finger assembly includes a lock which grips a corresponding end of the baling strap. The first and second strap tying assemblies operatively rotate around a compressed bale so as to direct the baling strap circumferentially around the bale. The strap tying assemblies and finger assemblies, in combination, articulating to bring the opposite ends of the baling strap into overlying relationship with one another, for friction welding, while the press is still forming the bale.

In one aspect of the invention, the first and second strap tying and finger assemblies operatively rotate in a downward direction so as to bring the opposite ends of the baling strap into overlying relationship with one another for welding in a region corresponding to the bottom of the formed bale. In another aspect of the invention the first and second strap tying and finger assemblies operatively rotate in an upward direction so as to bring the opposite ends of the baling strap into overlying relationship with one another for welding in a region corresponding to the top of the formed bale.

In a further aspect of the invention, a multiplicity of first and second strap tying assemblies are mounted in spaced-apart fashion along a mounting beam. The multiplicity of first and second strap tying assemblies simultaneously operating so as to tie a multiplicity of baling straps around a bale in a single operation.

BRIEF DESCRIPTION OF THE DRAWINGS

These and other features, aspects, and advantages of the present invention will be more fully understood when considered with respect to the following detailed description, appended claims, and accompanying drawings, wherein:

FIG. 9 is a is a semi-schematic end view of the automatic bale strapping system, at a sixth stage in the strapping operation, with the strapper heads in welding position and the strap being welded;

DETAILED DESCRIPTION OF THE INVENTION

Figure 3A:
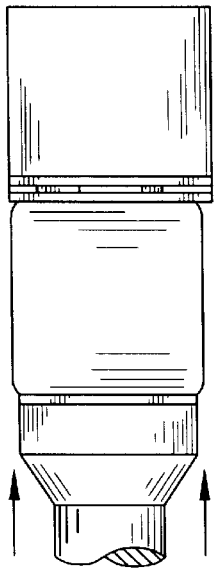
FIG. 3*a* is a simplified illustration of a bale being formed by a hydraulic press.
Figure 3B:
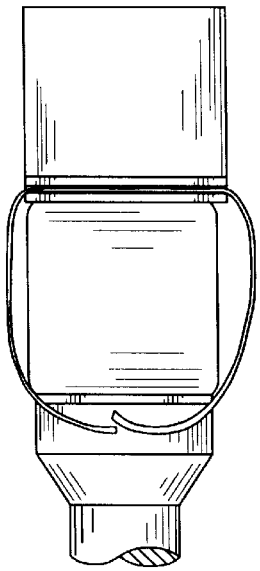
FIG. 3*b* is an illustration of a formed bale within a hydraulic press with thermoplastic straps inserted through the press and secured on the bottom (or top) of the bale.
Figure 3C:
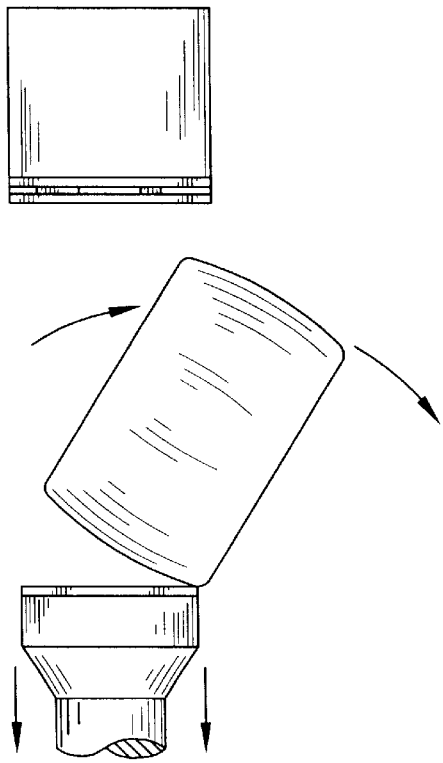
FIG. 3*c* is an illustration of the hydraulic press platens being released with the bale free to expand to the constraints of the strap and being ejected from the press.

Referring now to FIGS. 3*a*, 3*b* and 3*c*, there is shown a semi-schematic view of cotton, or other fibers, being pressed into a bale between the platens of a hydraulic press. Typically, fiber is pressed by a large hydraulic cylinder out of a box that measures approximately 30 inches wide by 54 inches long and 144 inches deep. Such a box is typically filled with approximately 500 pounds of cotton lint which is subsequently pressed into a 20 inch by 54 inch bale measuring approximately 20 to 22 inches tall (in accordance with the illustration of FIG. 3*a*). The box from which the bale is pressed has been omitted for the sake of illustrational clarity.

Strapping material, in the form of thermoplastic straps, are inserted through guide slots in the upper and lower platens, and are secured on the bottom (or top) of the bale (as shown in the illustration of FIG. 3*b*). Once the bale is tied, the press is released and the bale is free to expand to the constraints of the straps. As shown in the illustrated embodiment of FIG. 3*c*, the bale is then dumped out of the press, making way for a subsequent box loaded with an additional 500 pounds of cotton lint for pressing into the next bale.

Figure 1A:
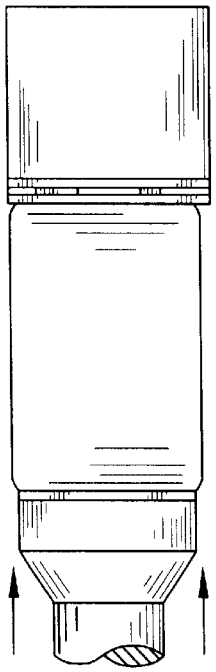
FIG. 1*a* is a simplified illustration of a bale being formed by a hydraulic press.
Figure 1B:
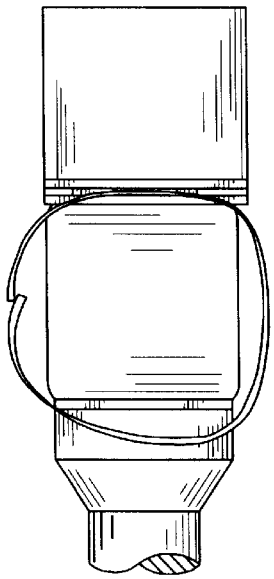
FIG. 1*b* is an illustration of a formed bale within a hydraulic press with thermoplastic straps inserted through the press and secured at about the mid-bale position.
Figure 1C:
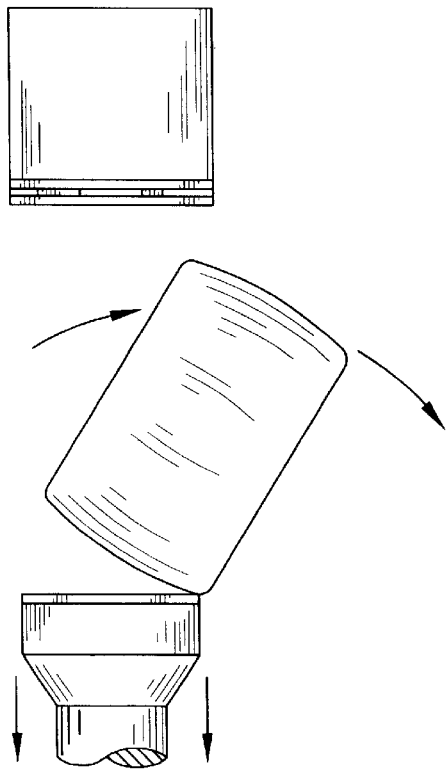
FIG. 1*c* is an illustration of the hydraulic press platens being released with the bale free to expand to the constraints of the strap and being ejected from the press.
Figure 2:
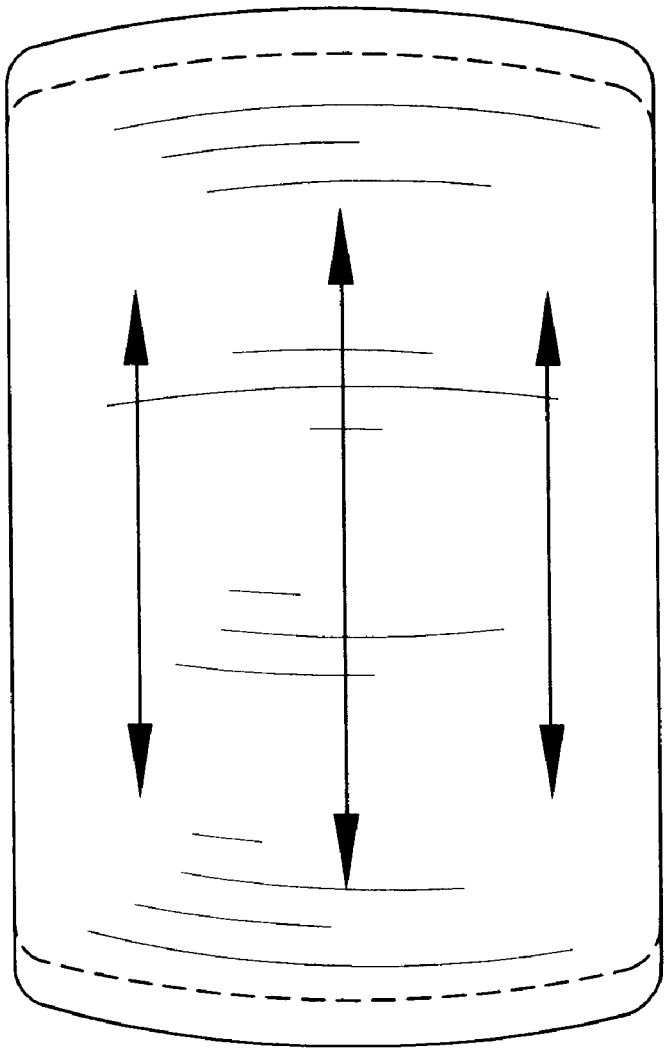
FIG. 2 is a semi-schematic end view of a compressed bale illustrating its expansion characteristics.

Returning momentarily to FIG. 2, it should be understood that securing the baling straps on the bottom (or top) of the bale allows the joint to be formed in a region of the bale where there is little or no stress in a direction parallel to the strap. In contrast to the prior art placement of the joint along the side of the bale, placing the joint on the bottom (or top) portion of the bale results in stress forces acting in a direction normal (or perpendicular) to the joint rather than parallel to the joint. This particular joint placement results in an approximately 20% to 35% joint stress decrease when compared to the prior art placement.

Accordingly, the bale tie strength may be seen to be up to the near maximum breaking strength of the strap since only uninterrupted strapping material is positioned in the high stress areas along the sides of the bale. Additionally, because of its placement, the joint knot recedes within the cotton product, as the bale expands to the constraints of the straps, such that the joint is not able to present a "sharps" to burlap bagging material, making the bales more easily and consistently baggable.

As will be described in greater detail below, all of the straps are tied in a single operation and all of the strap lengths are substantially uniform, such that tied bales are reasonable consistent in size and shape regardless of the weight, grade or moisture content of the baled cotton or other fibers. Accordingly, it can be understood that storage and shipping are rendered more efficient due to the improved stackability resulting from consistent and uniformly sized bales that can be obtained from practice of the present invention.

As will additionally be described in greater detail below, the strap feeder apparatus and cutting shears are able to operate while the press is still dropping, or while cotton boxes are being rotated into position for pressing. Neither of the aforementioned apparatus are high speed mechanisms, nor are they required during the physical strapping operation. Due to the structure and operation of the automatic bale strapping system in accordance with the invention, no separate tensioning device is required, making the strapping machinery system substantially less complex and bulky than one which is required to operate within a "strap time window" between completion of the bale pressing operation and subsequent bale removal from the press. In accordance with the present invention, the automatic bale strapping system incorporates the strap wrapping and joint formation operations into a single mechanism which is rotated beneath the bale so as to form the joint in the proper position. Due to the substantial size and complexity reduction of the system, the entire plurality of straps are put onto a bale at one time, in a single operation.

Figure 4:
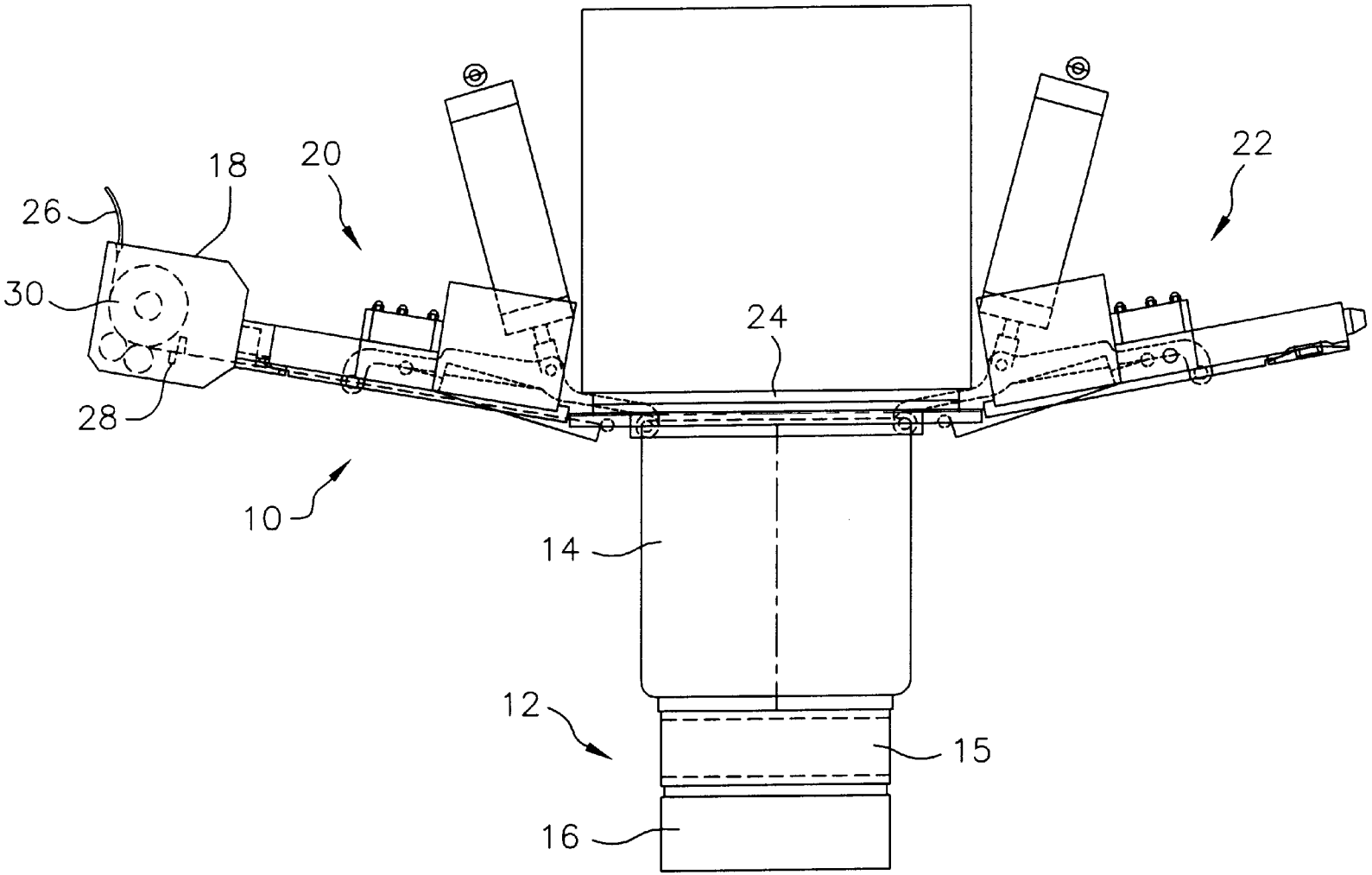
FIG. 4 is a semi-schematic end view of an automatic bale strapping system according to the invention, at a first stage in the bale strapping operation, with the feeder in place to feed strapping material across the apparatus and precut the strap.

Turning now to FIG. 4, there is shown a semi-schematic view of the side (or end) of a working embodiment of an automatic bale strapping system 10, provided in accordance with the invention, mounted on a cotton baling press 12. For clarity of illustration, the press 12 is shown in simplified view and with the front and back doors, typically provided on the baling chamber of such presses, omitted for the sake of illustrational clarity. The press 12 is depicted in open condition so as to provide access for tying a bale 14 compressed in the baling chamber by means of a moving press ram 16.

As is described in greater detail below, the automatic bale strapping system 10 is useful for tying a plurality of straps around a bale, such as bale 14, after the bale has been formed in the baling chamber. If desired, the system 10, provided in accordance with this invention, can be adapted to tie any number of straps circumferentially around the outside surface of the bale, but preferably is adapted to tie either 6 or 8 straps. In addition, although the bale strapping system 10 is described with particular reference to a cotton baling operation, it can be adapted for tying bales of other suitable materials or fibers as well.

A key feature of the bale strapping system 10 is that it is designed to be loaded with strapping material from a spool of such material (not shown) which is directed by a feeder 18 into the system from the front side of the press. For purposes of explanation herein, the front side of the bale strapping system is termed the "feeder" or "load" side while the back (or opposite) side is termed the "joint" or "weld" side.

An additional feature of the automatic bale strapping system 10 provided in accordance with the invention, is that it is designed to be affixed to, and used in combination with, either a conventional or a down-packer type cotton baling press. As will be described in greater detail below, particular features of the bale strapping system 10 allows for automatic tying of a plurality of thermoplastic straps around a cotton bale without the mechanics of the system interfering with the normal motion of either the press or the box loader turntable baseplate.

The bale strapping system 10 comprises two separate assemblies which operate together to automatically position and join together a plurality of thermoplastic straps around the bale 14. A first, strap assembly 20 and a second, weld arm assembly 22 are pivotally mounted on opposite sides of a center plate 24 which might, in turn, be affixed to or form part of the upper platen of the press 12. The strapper assembly 20 is mounted on the load side of the press while the weld arm assembly 22 is mounted on the weld side, as shown in the exemplary embodiment of FIG. 4. The bottom surface of the center plate 24 might form the roof of the baling chamber and would thereby provide one of the surfaces against which the bale 14 is compressed. The center plate 24 is provided with elongated, slotted channels formed in its bottom surface. The channels are open ended and extend from the front to the back side of the center plate 24 across its width. The straps when loaded into the bale strapping system 10 extend from the strapper assembly 20 to the weld arm assembly 22 through the channels. The straps exit the channels through the slots during the bale strapping operation, such that the completed bale can be removed from the press.

In the illustrated embodiment of FIG. 4, strapping material 26 is directed by the feeder assembly 18 into a slot or shoot provided for such purpose in the strapper assembly 20. Thence, the strapping material 26 is directed through the channels extending through the center plate 24 and into corresponding channels or chutes disposed in the weld arm assembly 22. As will be described in greater detail below, once the strapping material reaches the end of the weld arm assembly 22, cutting shears 28 dispose within the feeder assembly 18, cut the strap to a uniform, repeatable length.

Length reproducibility can be accomplished in a variety of ways. In particular, the feeder control wheel 30 might be provided with an electronic or mechanical counter, such that the feeder ceases feeding after a specific and pre-determined amount of material is directed therethrough. Alternatively, the weld arm assembly 22 might be provided with an abutment stop such that the strap can travel so far into the weld arm assembly until it butts up against the stop and can move no farther. At that point, a clutch sensor in the feeder assembly 18 would cause the feeder to cease operating and the cutting shears 28 operate to slice the strap to a repeatable length.

Once the foregoing operations are concluded, and all of the straps have been inserted and cut to length, the automatic bale strapping system 10 might be considered to be in a "loaded" condition. During this time, the bale 14 is being formed in the baling chamber and the press doors are closed. In the case where a plurality of bale strapping systems are disposed along the length of a press (and thus the bale) these operations are performed simultaneously.

Figure 5:
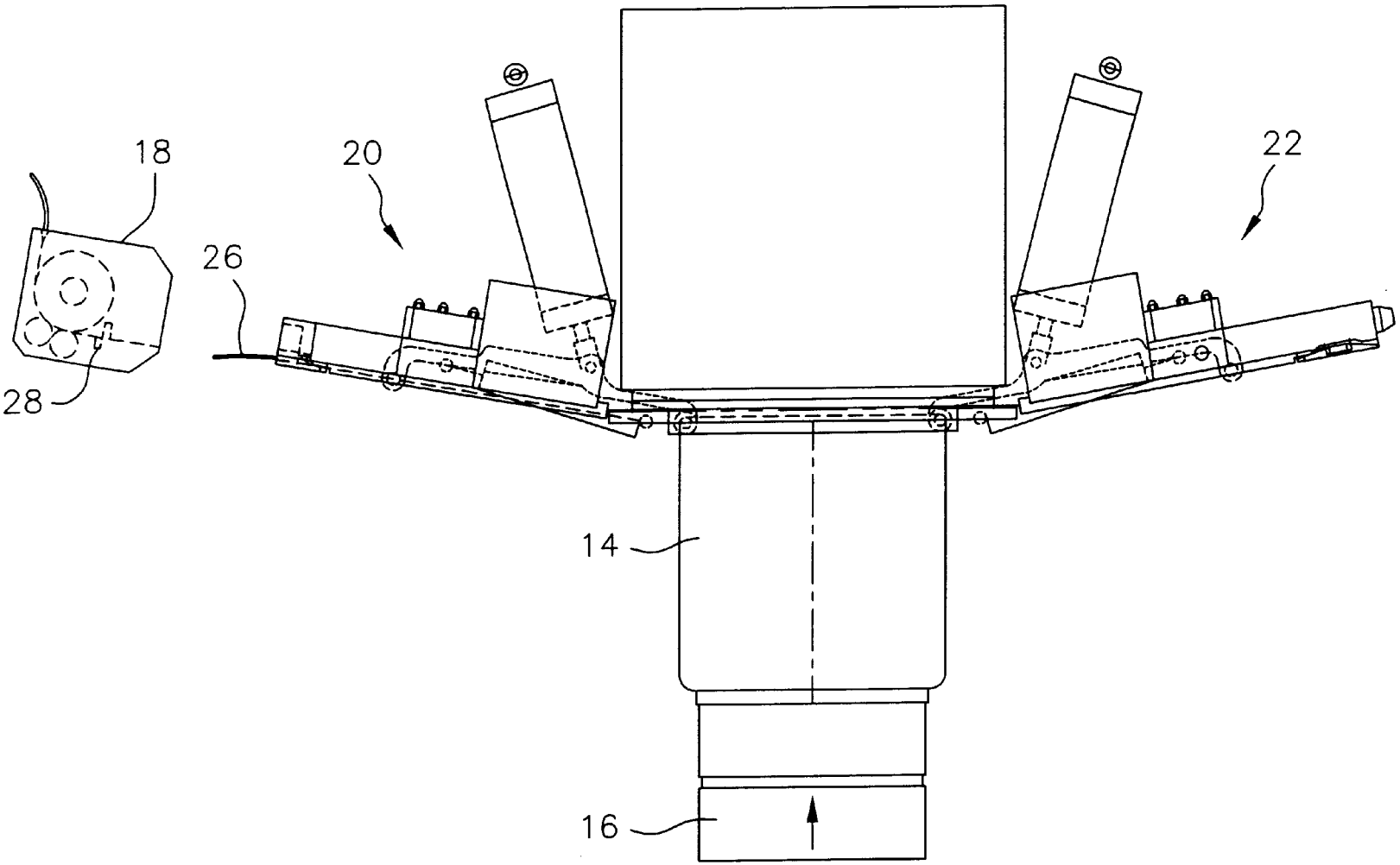
FIG. 5 is a semi-schematic end view of the automatic bale strapping system, at a second stage in the strapping operation, with the feeder moved back and the strapping material locked into the strapper.

Referring now to FIG. 5, once the strapping material 26 is pulled off the spool by the feeder unit 18 and fed across the apparatus through the channels and chutes, the feeder unit 18 stops. Strapping material 26 is locked into place in the strapper assembly 20 and the weld arm assembly 22 by hydraulically operated clamps positioned near the outboard ends of each of the assemblies. The strap is then cut to the desired length by the cutting shear 28. Next, the feeder assembly 18 is displaced from its position proximate to the strapper assembly 20 a distance sufficient to expose the cut end of the strapping material 26 which protrudes from the outboard end of the strapping assembly 20. The automatic bale strapping system 10 is now ready to begin the tying operation, even though the press ram 16 is still moving to compress the bale 14.

Figure 6:
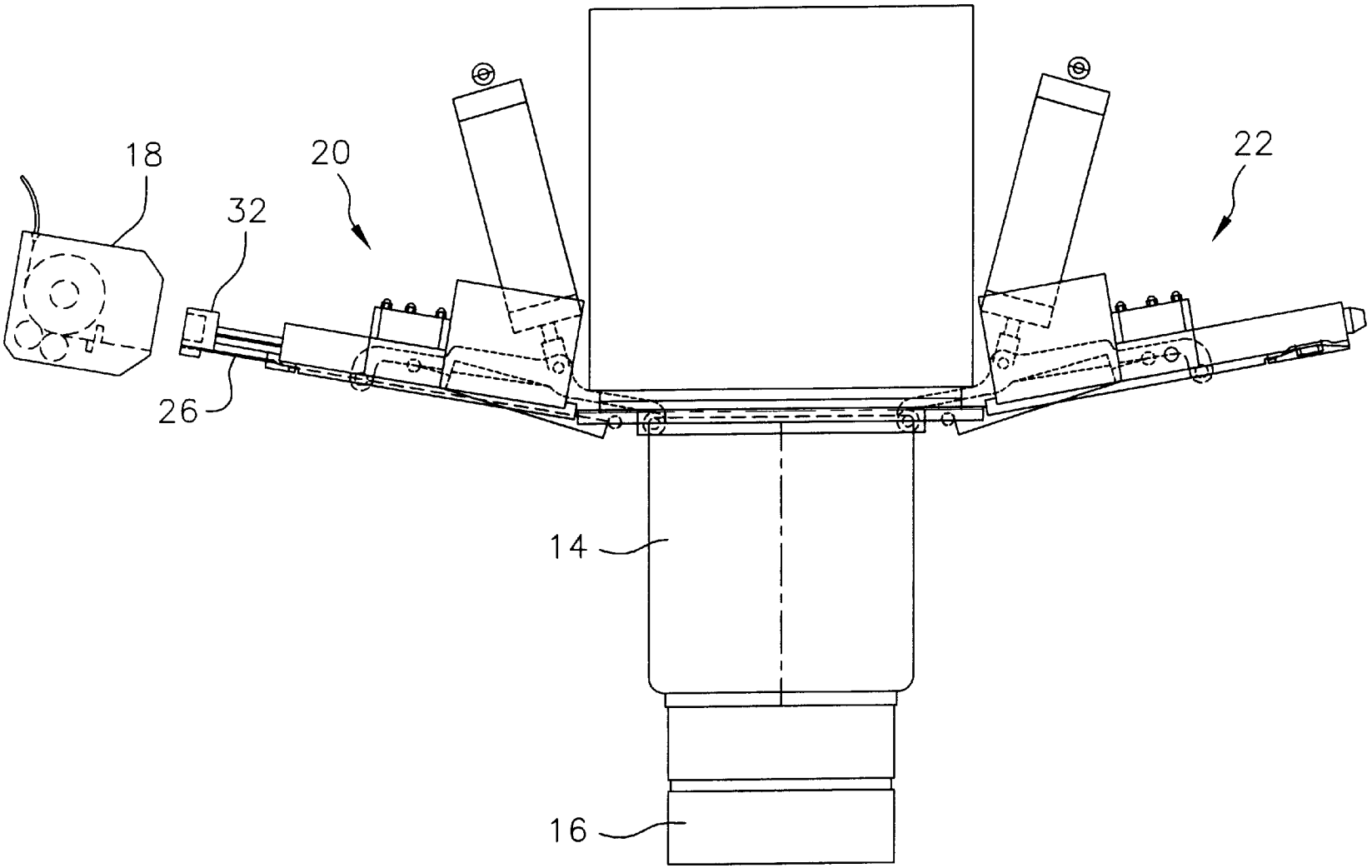
FIG. 6 is a semi-schematic end view of the automatic bale strapping system, at a third stage in the strapping operation, with the strapper tip support moved out to protect the strap during positioning to weld.

Turning now to the exemplary embodiment of FIG. 6, after the feeder assembly 18 is displaced from the strapper assembly 20, a strapper tip support sled 32 is hydraulically extended from the body of the strapper assembly 20 in order to cover the cut end of the strapping material 26 that had previously extended beyond the outboard end of the strapper assembly 20, as depicted in the exemplary embodiment of FIG. 5. The strapper tip support sled 32 functions to support the end of the strapping material 26 and subsequently guide its end of the strapping material 26 into precise registration with the other end of the strapping material held in the weld arm assembly 22. In accordance with the invention, the strapper tip support sled 32 not only protects the strap tip during positioning, but also positions and guides the strap tip during joint formation, as will be described in greater detail below.

Figure 7:
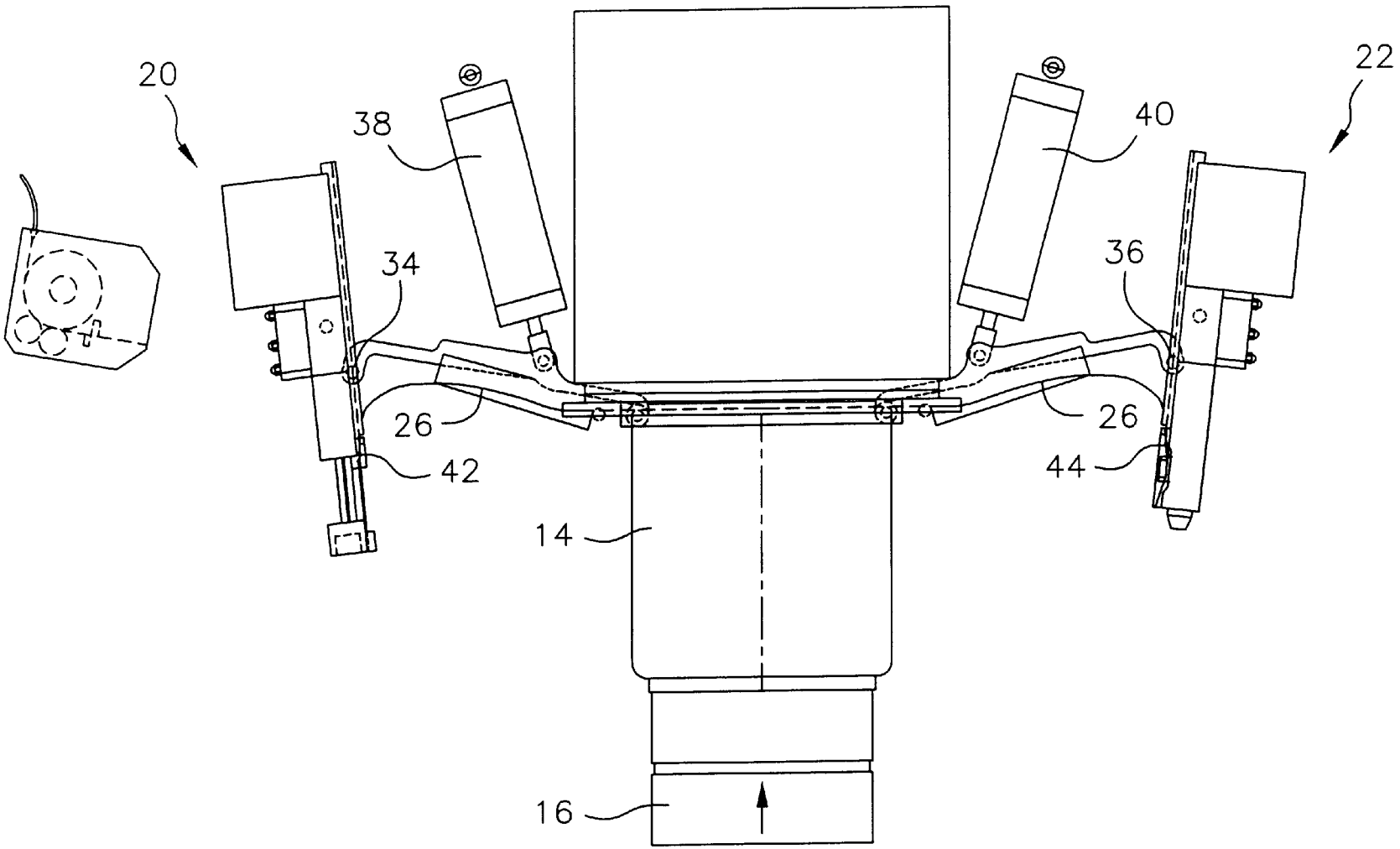
FIG. 7 is a is a semi-schematic end view of the automatic bale strapping system, at a fourth stage in the strapping operation, with the strapping heads bent down and the strapping material released from the loading shoot.

Turning now to the exemplary embodiment of FIG. 7, as the press ram 16 continues to compress the bale 14 the strapper assembly 20 and weld arm assembly 22 are pivoted from their loading orientation into their tying orientation. Both the strapper assembly 20 and weld arm assembly 22 are rotated about respective pivot points 34 and 36 by corresponding hydraulic cylinders 38 and 40. Prior to rotation, the loading chutes disposed along the bottom of the assemblies are caused to open, thereby allowing the strapping material 26 to fall free of the assemblies except where they are held withing each assemblies outboard end by a mechanical pressure or "pinch" lock 42 and 44, respectively. Both the strapper assembly 20 and weld arm assembly 22 are now bent down with the strapping material locked into place and the strap chute doors in the open position. It should further be understood that this operation takes place while the press ram 16 is still moving in order to compress the bale 14.

Figure 8:
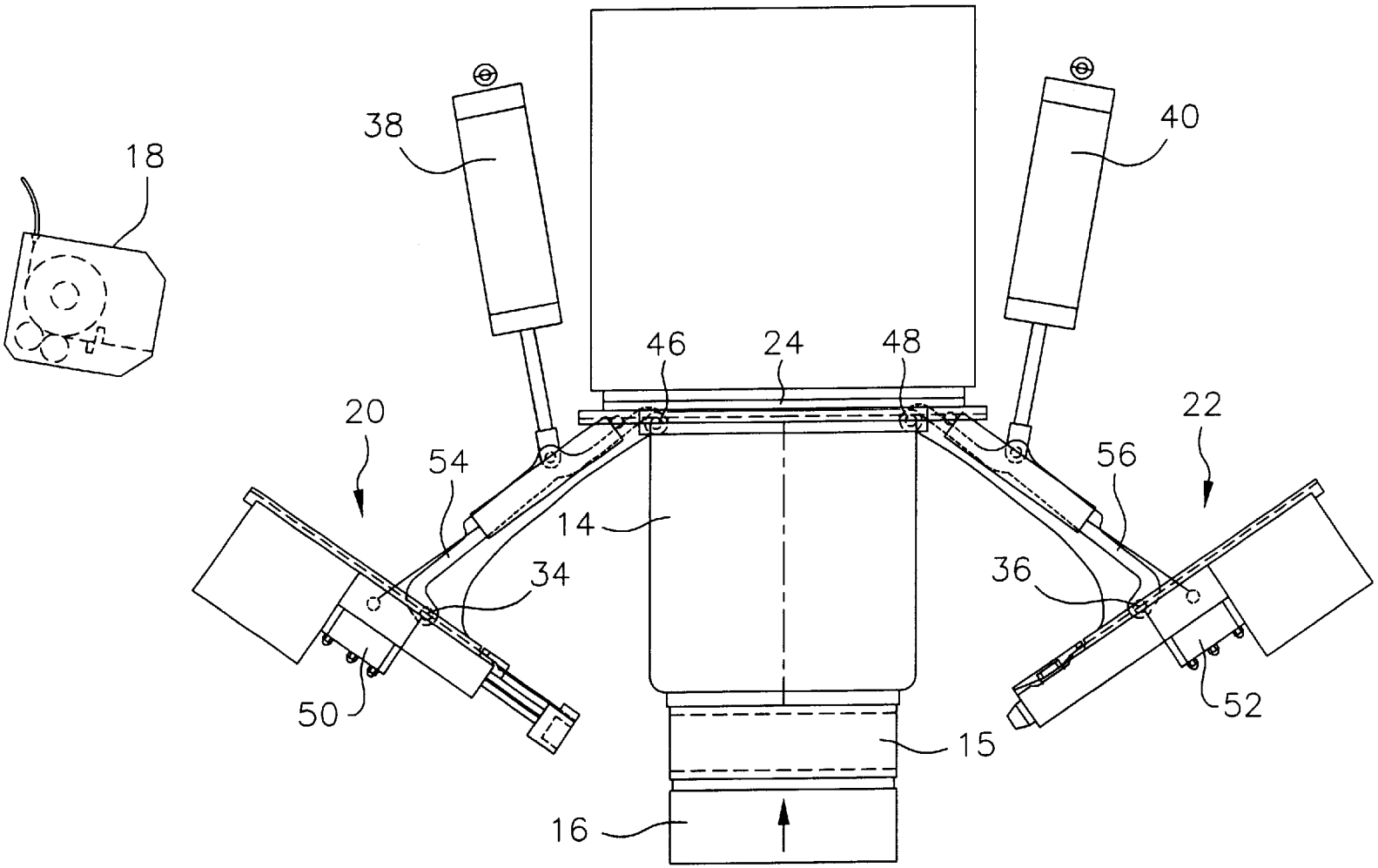
FIG. 8 is a is a semi-schematic end view of the automatic bale strapping system, at a fifth stage in the strapping operation, with the strapping heads moved into the pre-tie position.

Turning now to FIG. 8, the exemplary embodiment shows the strapper assembly and weld arm assembly 22 being moved into the pre-tie position as the press ram 16 completes the bale pressing operation. Both the strapper assembly and weld arm assembly are rotated about respective pivots 46 and 48 by the respective hydraulic cylinders 38 and 40. In this regard, each of the arm assemblies 20 and 22 include a respective finger assembly 50 and 52, termed the strapper finger assembly and the weld arm finger assembly herein. Each finger assembly is coupled to the center plate 24 by respective arms 54 and 56 which are pivotally coupled to the center plate 24 at pivot points 46 and 48, respectively, and each of which is further pivotally coupled to its respective finger assembly at pivot points 34 and 36 respectively. Pneumatic cylinders 38 and 40 are connected to each arm 54 and 56 for pivoting the arms and, thus the strapper assembly 20 and weld arm assembly 22 from their fully raised positions to their fully lowered positions.

With reference now to the exemplary embodiment of FIG. 9, the strapper and weld arm finger assemblies 50 and 52 have been inserted into receiving channels provided in the follow block 15, such that their outboard ends are in contact with one another and with the strapping material 26 held by the strapper assembly 20 having been inserted into the welding channel of the weld arm assembly 22, in a manner to be described in greater detail below. In particular, as the strapper finger 50 comes into contact with the weld arm finger 52, the front edge of the weld arm finger butts up against the strapper tip support sled 32 and forces the sled back into the body of the strapper assembly, thereby exposing the strapping material previously protected by the sled. As the tip of the weld arm finger 52 continues to push the sled 32 back into the body of the strapper finger, it receives the exposed strapping material into a guide chute which is provided in registry with the sled such that the weld arm finger slides over the exposed strapping material until the sled 32 is fully pushed back into the body of the strapper finger and the supported strapping material end is fully inserted into the weld arm finger.

As can be understood from the exemplary embodiment of FIG. 9, the thermoplastic strapping material 26 has now been formed around the compressed bale 14 with the ends of the strapping material 26 positioned beneath the bale for welding, as opposed to being positioned along the bale's sides. Since the majority of the operations described in connection with the embodiments of FIGS. 4 through 9 can be performed while the press ram 16 is still moving to compress the bale 14, it should be understood that this results in a significant reduction in the time required to press and strap a bale. The only additional time necessary for operation of the automatic bale strapping system according to the invention, is the time required to move the strapper and weld arm assemblies from their pre-tie positions as illustrated in FIG. 8 to their fully closed and weld positions as illustrated in FIG. 9. Strapping material 26 is initially pre-cut to a specified length and pre-loaded into the system regardless of the state of the press or how far along the press is during the baling operation. Because each of the straps are initially pre-cut to the same specified length, all of the straps disposed along the length of the bale are substantially the same, forcing the shape of the bale to remain substantially uniform along its length, in response. Being of uniform length, each of the straps is subject to a substantially similar amount of stress, such that no one strap, or set of straps, is taking a greater load than any other. The possibility of stress induced failure is therefore greatly minimized.

Further, the symmetrical arrangement of the component assemblies of the automatic bale strapping system across the front and back sides of the baling press and its pivotal connection to the stationary top plate of the press, allows the system to be loaded and articulated into a variety of pre-tied positions without interfering with intermediate operation of the press. All that is required is that the press complete the pressing operation while the outboard ends of the strapper and weld arm finger assemblies are poised to enter the follow block, with follow block entry and strap welding operations proceeding as soon as the press ram reaches a particular spatial location and activates a limit switch, for example.

Naturally, once the strap tips have been juxtaposed within the weld arm finger assembly 52, the overlapped ends are welded together, the locks released and the finger assemblies retracted from beneath the bale by the hydraulic cylinders 38 and 40 until they once again reach the load position illustrated in FIGS. 4 and 5. The feeder assembly 18 is moved into position against the strapper assembly 20, a new length of strapping material 26 is fed across the system and cut to length. The feeder assembly 18 is then again retracted and the system is ready to apply straps to the next bale.

A particular advantageous feature of the automatic bale strapping system of the invention is its ability to engage in the strapping operation while the press ram is still moving. In particular, both the strapper and weld arm finger assemblies are poised to enter corresponding slots in the follow block 15 during the last few inches of press ram travel. As has been described above, both of the finger assemblies are pivoted into position by corresponding swing arms 54 and 56 controlled by corresponding hydraulic cylinders 38 and 40. However, it should be understood that the respective fingers need to be aligned with one another at the completion of the tying process in order that strapping material disposed within the strapper finger 50 be correctly inserted into the weld arm finger 52. As the strapper and weld arm assemblies are pivoted downwardly from their fully raised to their fully lowered positions, the strapper and weld arm fingers are thereby swung in an arcuate fashion, to an angular position such that their respective outboard tips contact one another in the respective closure cavities of the follow block.

Figure 10A:
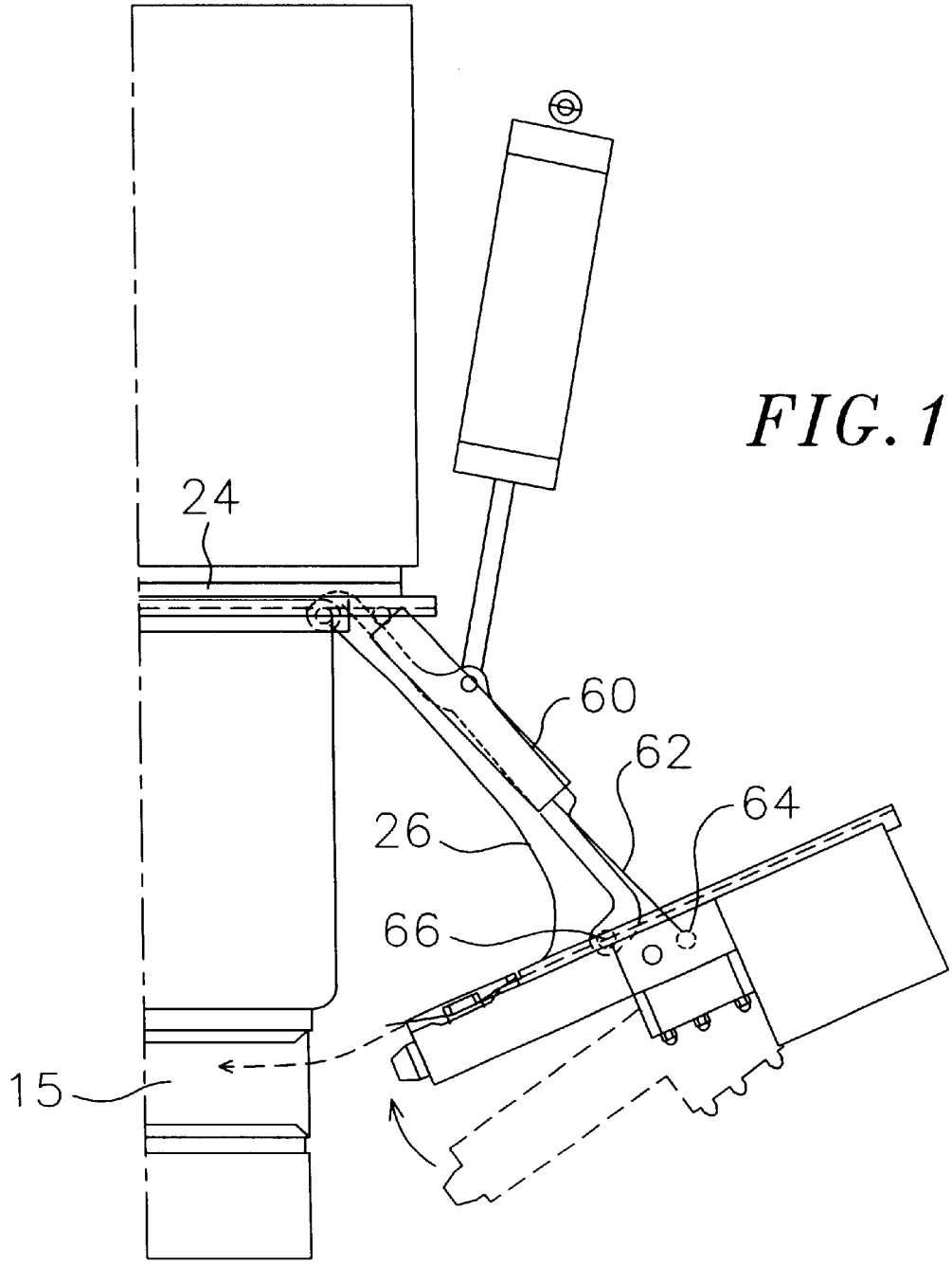
FIG. 10*a* is a semi-schematic cross-sectional view of a level arm positioning system according to the invention positioning a weld arm finger for insertion into a follow block closure cavity.

Referring now to FIGS. 10*a, b* and *c*, each of the finger assemblies are guided into proper position in their respective closure cavities by a level arm assembly 60. The level arm assembly 60 suitably comprises a hydraulic cylinder pivotally coupled to the center plate 24 and an actuator arm 62 extending from the cylinder to a pivot point 64 on each respective finger assembly. Once each of the finger assemblies are free to enter their respective follow block cavities, the level arm assembly 60 functions to apply a torque to each finger assembly which, in turn, forces each finger assembly attached thereto into the same angular aspect with respect to the follow block 15 and, consequently, to mirror image angular aspects with respect to one another. The action of the level arm assembly 60 thereby controls the angular position of each of the finger assemblies as they travel along the follow block closure cavity. Once each finger assembly's outboard end (or tip) enters each respective closure cavity, the geometry of each level arm assembly's pivot point 64 maintains each respective finger assembly in level position through its final travel motion. The geometrical placement of the level arm assembly pivot point 64, outboard each finger assembly's rotational pivot point 66 ensures that each respective finger is suspended in the correct position within the closure cavity for eventual engagement with the tip of the other finger assembly and, thereby eventual engagement of the opposing tips of the strapping material 26, in a manner to be described more fully below.

In operation, the level arm assembly 60 is allowed to "float" until the strapper assembly and weld arm assembly have been lowered and their respective finger assemblies rotated into the pre-tie position, as illustrated in FIG. 10*a*. For purposes of illustrational clarity, only the backside, or weld arm assembly side, of the system is shown. It should be understood that a corresponding level arm assembly is provided on the strapper assembly and functions, in mirror image fashion, to control the strapper assembly in the same manner as level arm assembly 60 controls the weld arm assembly in FIGS. 10*a, b*, and *c*.

Figure 10B:
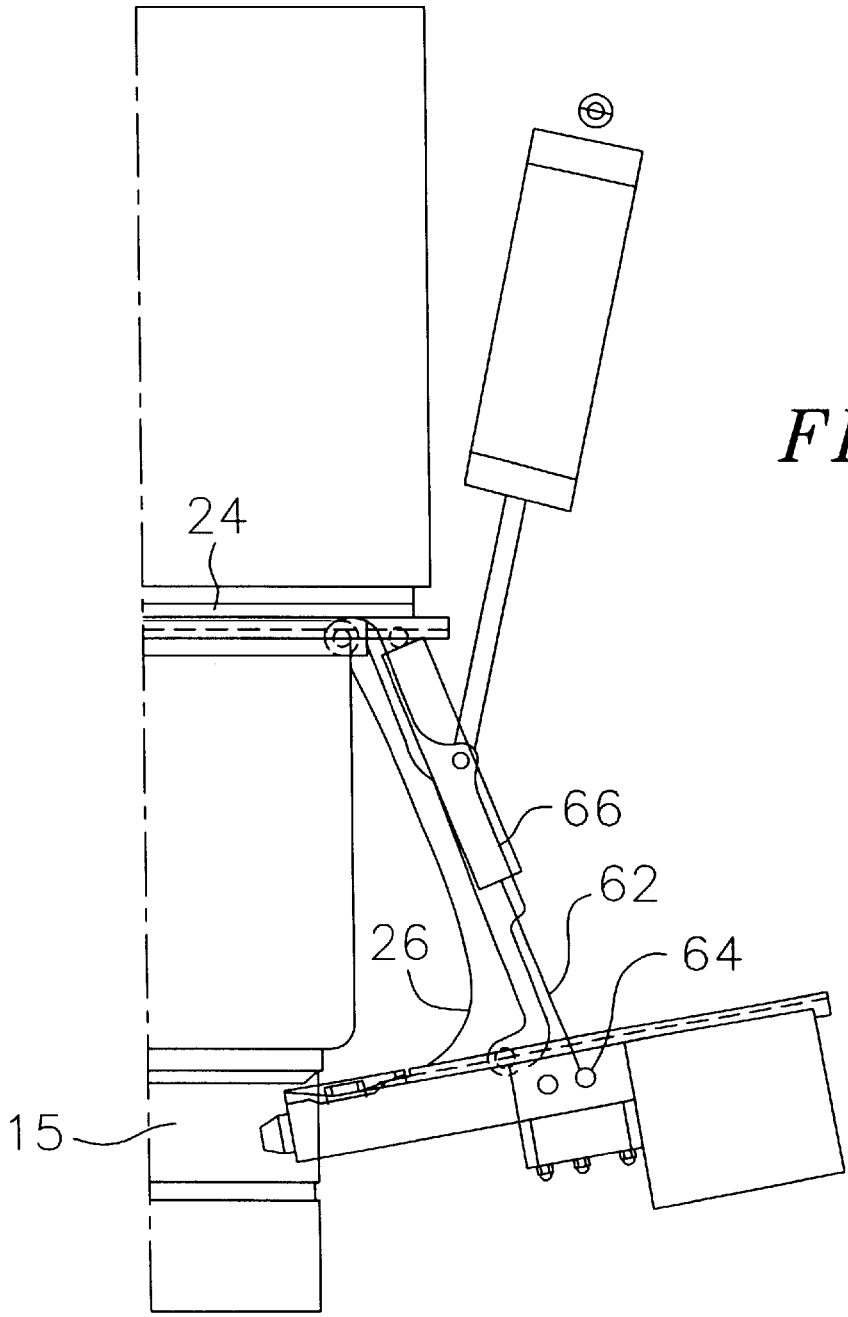
FIG. 10*b* is a semi-schematic cross-sectional view of a level arm positioning system at a second stage in the weld arm finger insertion process.

Turning now to FIG. 10*b*, as the press ram continues to compress the bale, the follow block structure 15 continues to move upwardly in response to pressure from the press ram. The weld arm finger assembly 52 is rotated into its respective closure (or weld) cavity within the follow block 15. At this particular juncture, the finger assembly 52 is rotated by the level arm assembly 60 in a slightly clockwise direction (from the perspective of FIG. 10*b*) in order to present a shallow acute aspect angle to the follow block 15 in order that the finger assembly tip might easily enter the follow block closure cavity along a relatively linear travel path, as opposed to an arcuate one. Adjusting the presentation angle of the finger assembly tip with respect to the follow block allows the finger assembly tip to be guided in a linear fashion into the closure cavity as opposed to an arcuate one which would necessitate the closure cavity being large enough to accommodate a radiused travel path.

Figure 10C:
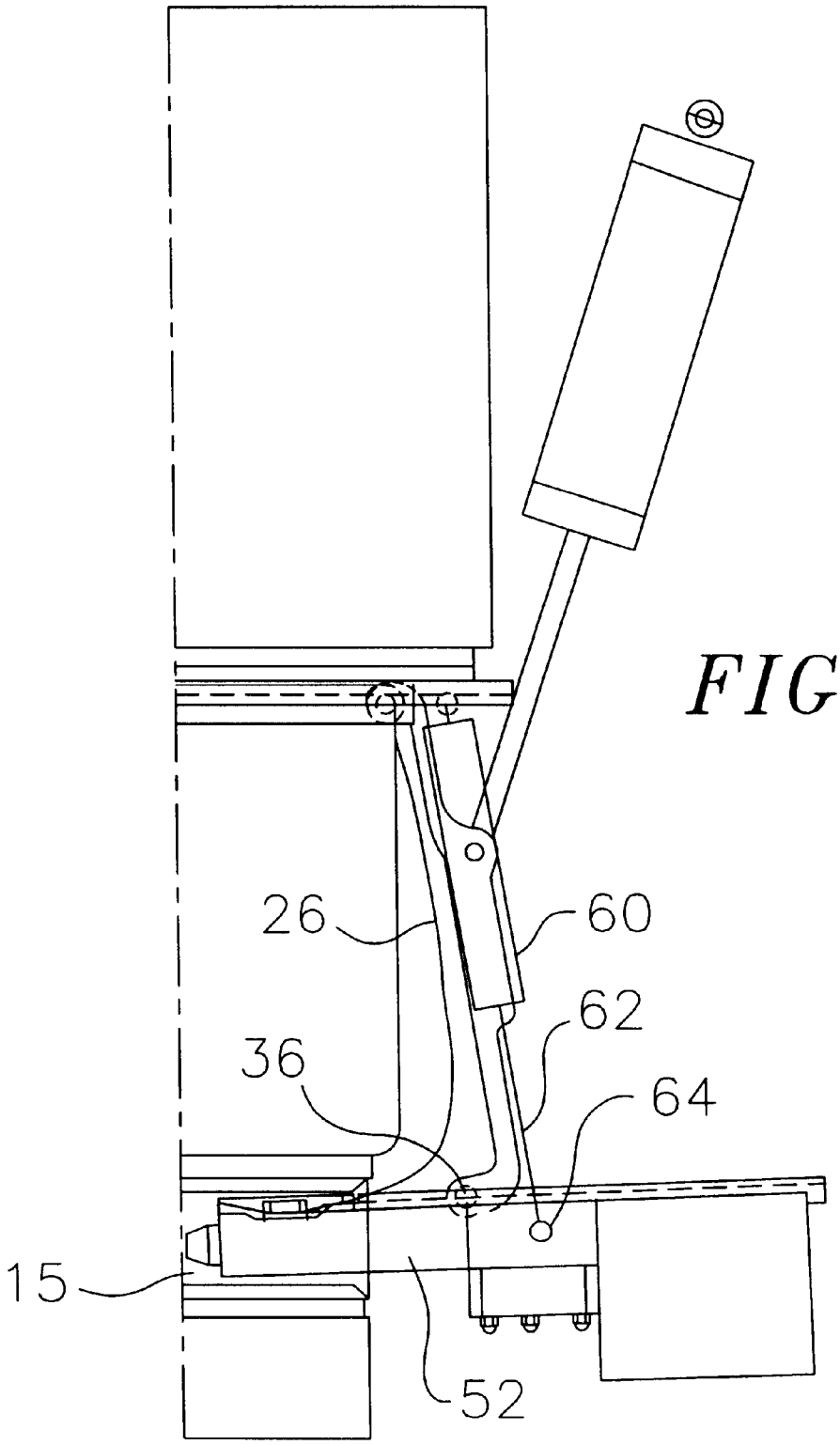
FIG. 10*c* is a semi-schematic cross-sectional view of a level arm positioning system at a third stage in the insertion process, illustrating the horizontal (level) orientation of a weld arm finger after insertion into the follow block.

With reference now to the exemplary embodiment of FIG. 10*c*, the finger assembly 52 has now been substantially completely inserted into its respective closure (or weld) cavity in the follow block 15 and is ready to engage the correspond tip of the opposite finger assembly in order that the opposing strap ends might be juxtaposed for welding. In this particular instance, it is desirable that each of the respective finger assemblies be maintained in a horizontal position throughout the final few inches of travel such that their respective strap ends are disposed in substantially the same horizontal plane upon finger contact. Since each of the finger assemblies are pivoted into position by their respective pivot arms (54 and 56 of FIG. 8) the finger assemblies would necessarily travel along an arcuate path and only be disposed in the same horizontal plane at one tangential instant, unless some means were provided to maintain the finger assemblies in the same horizontal plane. Lever arm assembly 60 provides such a function by counter rotating each finger assembly 50 and 52 about its respective arm pivot points 34 and 36 in controlled fashion. It should also be noted that the lever arm assembly provides means for initially pivoting each of the finger assemblies in a downwardly direction about their respective arm pivot points 34 and 36 after the strap loading operation has been completed. The hydraulic cylinders (38 and 40 of FIG. 7) operate to rotate the entire assemblies from their fully raised to fully lowered positions by acting upon each assembly's pivot arm 54 and 56. In summary, the hydraulic cylinders 38 and 40 control the rotational aspect of each assembly, while the level arm assembly 60 controls the rotational aspect of each of the respective finger assemblies.

When both of the finger assemblies have been horizontally disposed within their respective closure cavities of the follow block 15, the opposing ends of the strapping material are juxtaposed (lapped) over one another are now in position for welding. Because the fingers are oriented in a substantially horizontal plane, the opposing strap ends are guided into proper position for welding and held in place, against vertical or lateral movement, once the opposing ends have overlapped one another. The horizontal orientation of the finger assemblies allows the strapping material to be biased into proper position without the torquing or other misalignment problems typically associated with convention chute-guided, post-pressing strapping systems.

A further advantageous feature of the present invention, and as will be particularly described below, is that the parallel orientation of the strapping material and the respective finger assemblies allows for a friction joint weld to be made in a direction along the length of the strap, as opposed to conventional systems in which a friction joint weld is made in a direction lateral to the strap, i.e., across its width. Making a parallel joint, as opposed to a perpendicular joint, ensures a more uniform joint area and a more uniform joint integrity, when compared to conventional thermoplastic strap offset joints.

Figure 11:
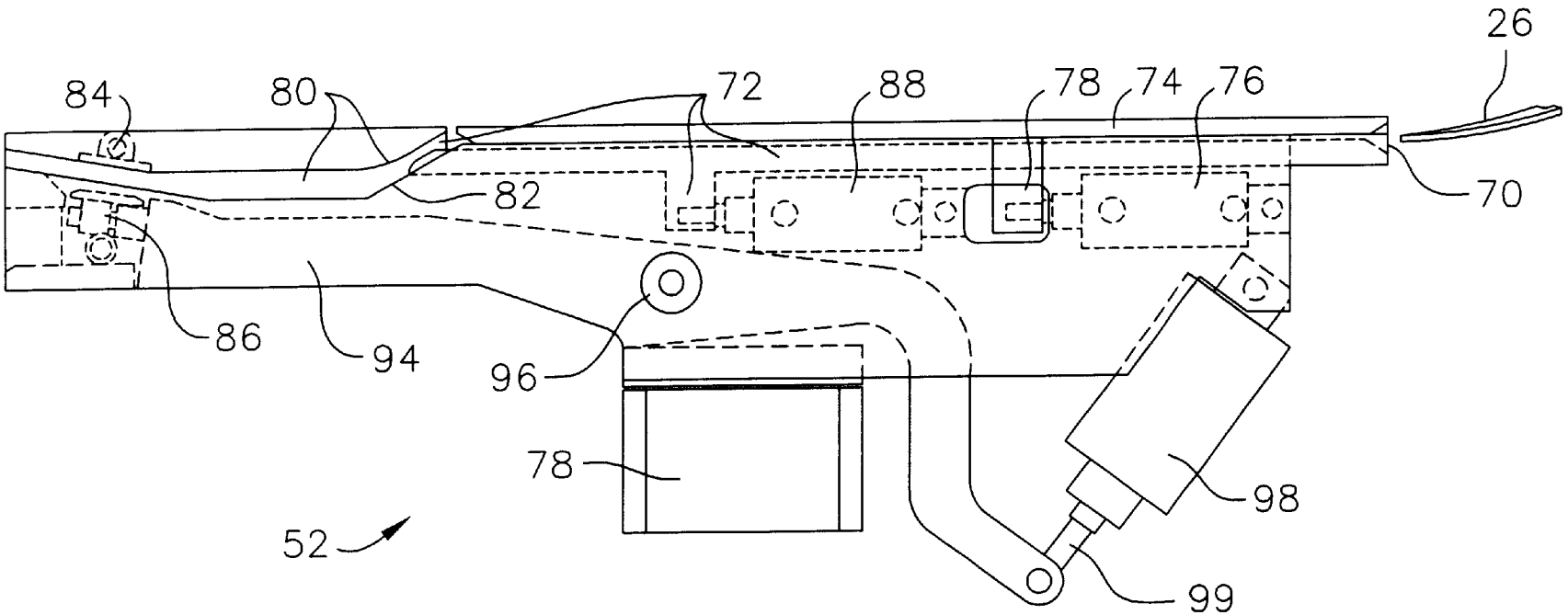
FIG. 11 is a semi-schematic partial cross-sectional view of a weld arm finger assembly detailing its internal construction and operation during a strap insertion portion of a bale strapping operation.

Loading of the strapping material 26 into a weld arm finger assembly 52 in operation of the automatic bale strapping system for automatically wrapping straps around a compressed bale and welding the strap ends together, can be best understood by referring particularly to FIGS. 11–16. Referring first to FIG. 11, there is shown a semi-schematic, simplified cross-sectional view of a weld arm finger assembly 52, detailing the internal components of the finger assembly as strapping material 26 is inserted therein at the beginning of a tying operation. In particular, strapping material 26 is inserted into a chute 70 which is constructed as a wide, shallow, flat-bottomed u-shaped section, with a width and height dimension sufficient to retail a piece of strapping material without unduly binding or pinching the material during operation. The chute 70 has solid sides which comprise the body material of the weld arm assembly 52 and a longitudinally movable floor 72 which further functions as a lock mechanism, in a manner to be described in greater detail below. A laterally sliding door member 74 is provided as the top surface of the chute and is maintained in position over the top of the chute during the strap loading operation and during the subsequent arm assembly and finger assembly pivoting operations, in order to retain the strapping material within the chute. As will be described in more detail further, the door 74 slides laterally, across the top surface of the finger assembly in order to expose the chute below and allow the contained strapping material to float free from the chute, and thus the finger assembly, after the welding operation has been concluded and the bale is ready to be expelled from the press. The door 74 might be a single piece of material which is slid laterally to expose the chute below, or alternatively might be two pieces of material that are slid away from one another to thereby expose the chute interior. Accordingly, the door mechanism 74 might be characterized as a set of doors that move horizontally across the top of a finger assembly in order to contain or release the enclosed strapping material from a chute having solid sides and movable floor that also functions as a lock. The door mechanism 74 is actuated by a door hydraulic cylinder 76, which is coupled to the door mechanism 74 by linkage arms 78.

It should also be worthwhile to note, at this stage, that each of the finger assemblies (50 and 52 of FIG. 8) is mounted on a main beam 78 which extends in the direction of the length of the bale (14 of FIG. 4) and ties all of the finger assemblies on each respective side of the bale together. As many finger assemblies as is required to tie a sufficient number of straps around a bale may be mounted upon the main beam 78, so long as sufficient closure cavities are provided in the press follow block to accommodate finger insertion and the strap welding operation. The main beam 78 rigidly supports each of the finger assemblies such that all of the plurality of finger assemblies disposed on one side or the other of the press move in unison during the pivoting, insertion and welding operations.

Figure 12:
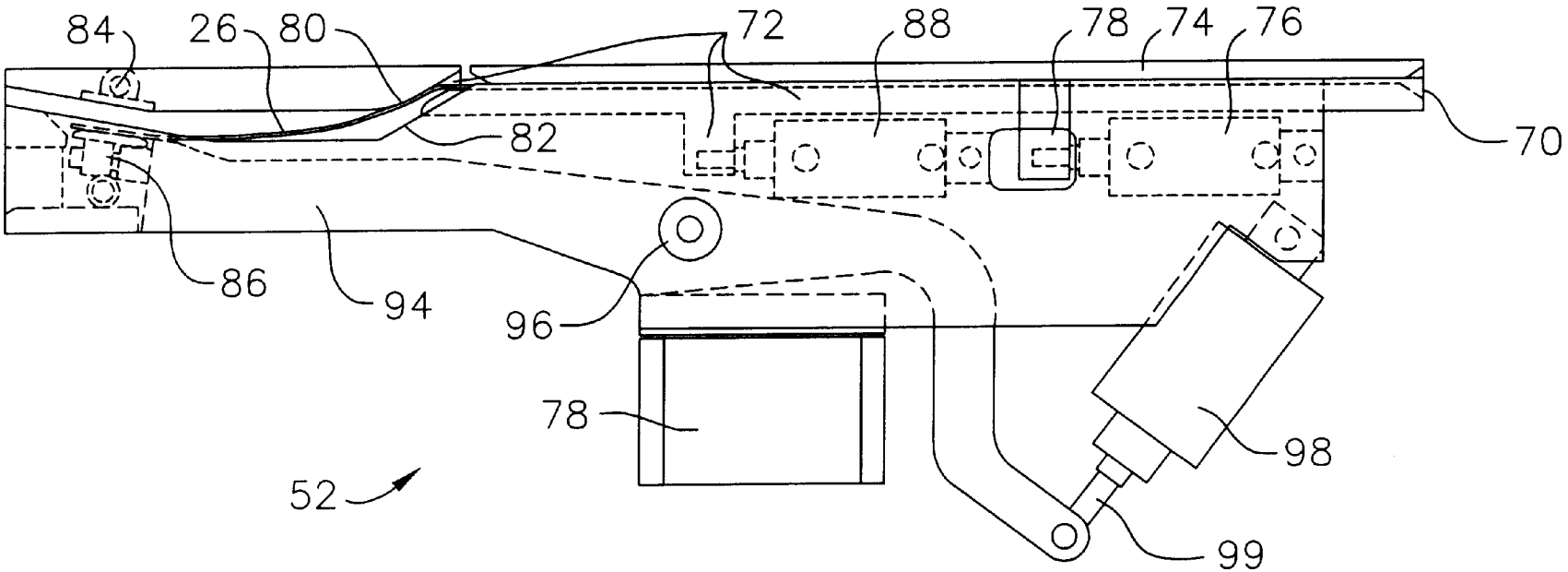
FIG. 12 is a semi-schematic partial cross-sectional view of a weld arm finger assembly at a second stage in the strap insertion process.

Turning now to FIG. 12, the semi-schematic, cross-sectional view of the weld arm finger assembly 52 illustrates the positioning of the internal components once strapping material 26 has been inserted through the chute 70 and has been fully fed into the weld arm finger assembly. As shown in the exemplary embodiment of FIG. 12, the front portion of the strapping material 26 has been extruded through the chute 70 and into a generally curved track comprising the front, or weld, portion of the weld arm finger assembly 52. As the strap material 26 enters the curved portion, it first traverses through a Chicane section 80 which forces the strap material 26 to be forced downwardly towards the weld portion's floor 82, which in turn, guides the strap material 26 into position between a top welding plate 84 and a movably disposed bottom welding plate 86. Strap material 26 rests upon a welding pad forming the top surface of bottom welding plate 86 and is pressed into place upon the welding pad by pressure exerted by its traverse of the Chicane 80. The strap material 26 is thus in a bowed and stressed condition imparted by the non-linear geometry of the front, weld portion, channel of the weld arm finger assembly 52.

Figure 13:
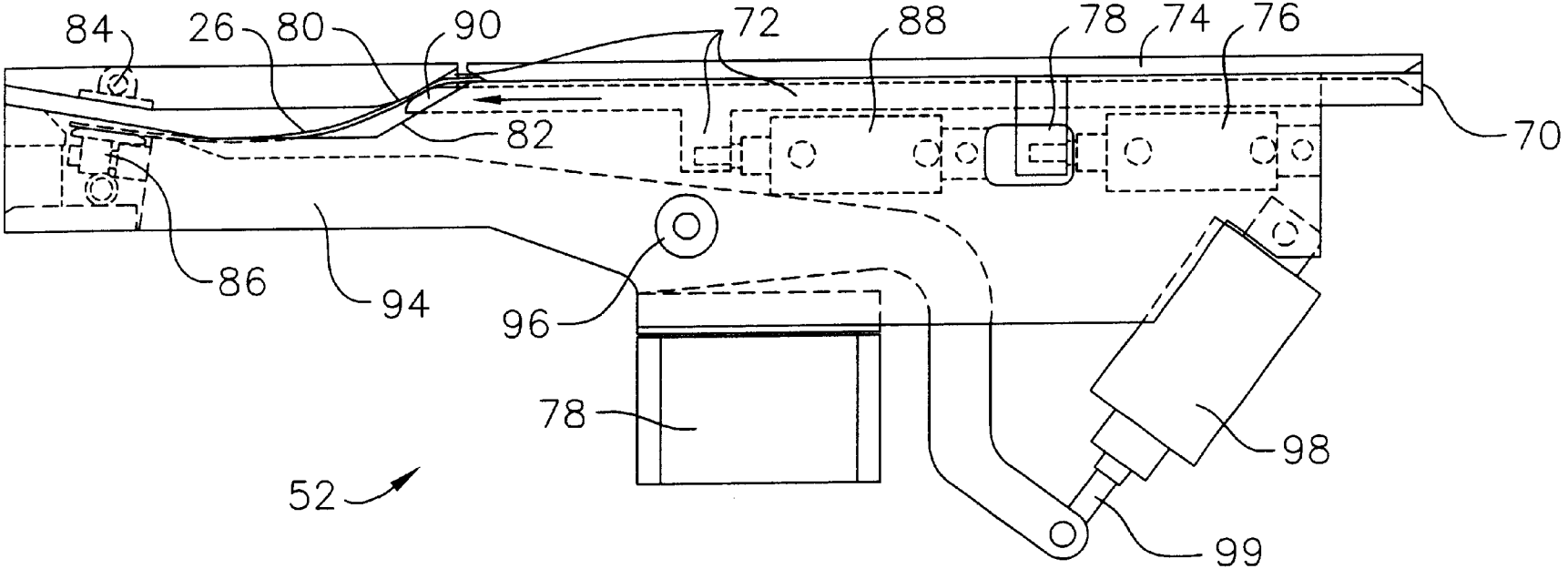
FIG. 13 is a semi-schematic partial cross-sectional view of a weld arm finger assembly detailing the locking mechanism and bow-forming Chicane.

Turning now to FIG. 13, once the strap material 26 has traversed the Chicane 80 and has its distal end disposed over the surface of the bottom welding plate 86, the floor 72 of the chute 70 is caused to translate in a forward direction by a hydraulic "lock" cylinder 88. As the floor 72 section of the chute 70 travels forward, its distal end 90 is forced toward the Chicane 80 until the strapping material 26 is forcibly pinched between the chute floor 72 and the Chicane surface 80. The strapping material 26 is thus held in position against translational movement, back and forth in either the chute 70 or the weld portion channel. It should further be understood that action of the "lock floor" 72 in pinning strapping material 26 against the Chicane surface 80, increases the bow pressure on the strapping material 26 such that the tip of the strapping material presses more securely upon the weld surface of the bottom welding plate 86.

Figure 14:
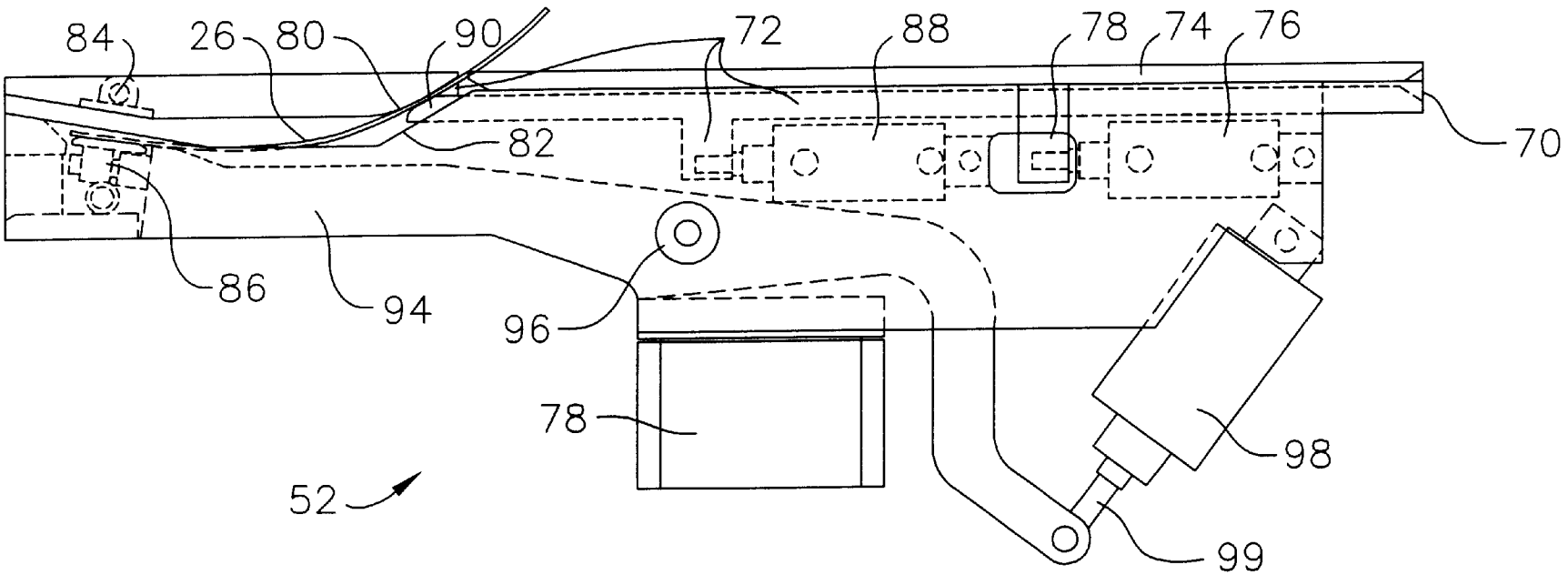
FIG. 14 is a semi-schematic partial cross-sectional view of a weld arm finger assembly at the strap release stage of the process.

With regard to FIG. 14, the weld arm finger assembly 52 is illustrated in semi-schematic cross-sectional form, after the strap loading operation is complete and when the finger assemblies have been pivoted into their tie positions as illustrated in the exemplary embodiment of FIG. 7. As can be seen from FIG. 14, the strapping material 26 has been released from the loading chute 70 and is retained within the finger assembly 52 solely by the lock 72 pinching the strapping material 26 against the Chicane surface 80. At this particular point, the door assembly 74 has been displaced by action of the hydraulic door cylinder 76 in order that the interior of the chute 70 be uncovered, thus allowing the strapping material 26 to float free from the chute and be wrapped around a compressed bale without further constraint. The lock assembly 72 prevents the strapping material 26 from being pulled out of the weld portion of the weld arm finger assembly or from being pulled back off the vibrator pad surface of the lower weld pad 86. The lock 72 further prevents reduction of the bow tension induced in the strapping material 26 by the Chicane surface 80 of the weld portion of the weld arm finger assembly 52.

Figure 15:
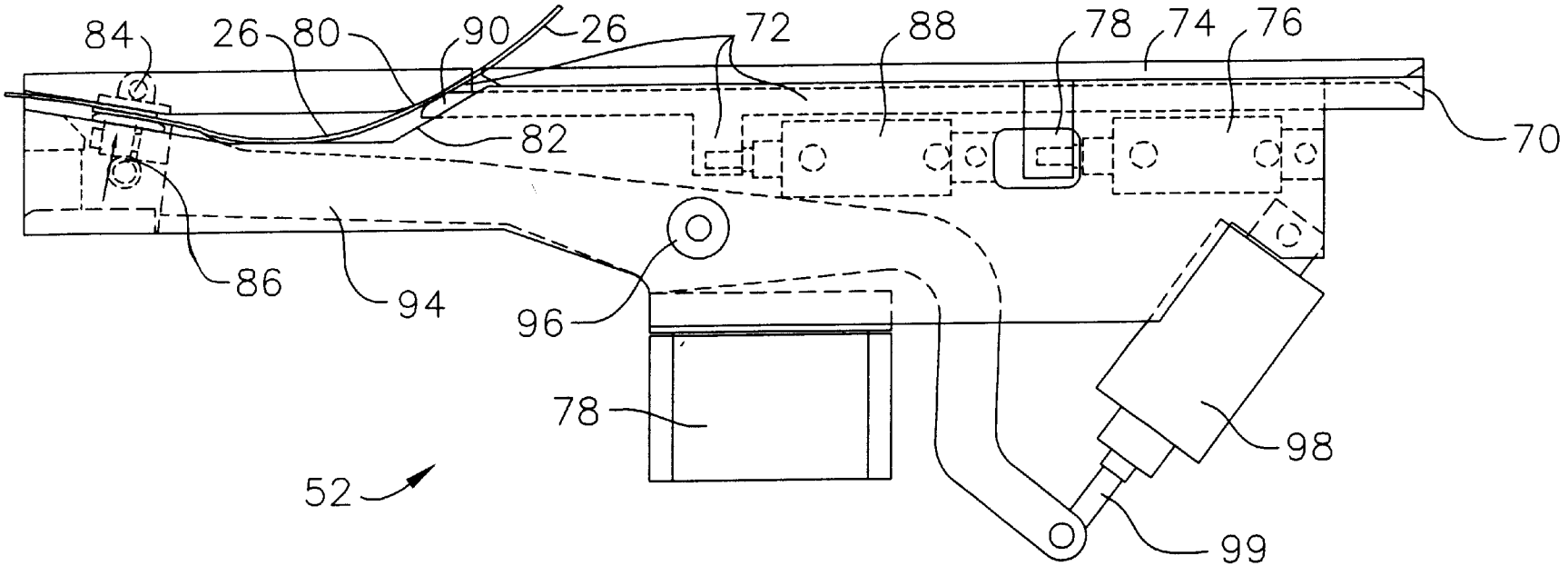
FIG. 15 is a semi-schematic partial cross-sectional view of a weld arm finger assembly during the weld portion of the process.

Turning now to FIG. 15, the weld arm finger assembly 52 is depicted in semi-schematic, cross-sectional view at a point in the operation after both finger assemblies have entered their respective closure cavities in the follow block and after the opposing strap tip has been delivered from the strapper tip support sled (32 of FIG. 6) into the weld arm finger assembly and fed over the end of the corresponding strapping material 26 contained within the weld arm finger assembly 52. The strapping material 26 and the opposing strap end 92 overlap one another in the region between upper and lower weld plates, 84 and 86 respectively, which have closed over the overlapping strap portions in order to provide a weld joint.

In this regard, the lower weld plate 86 is coupled to a pivot arm assembly 94 which pivots about an eccentric pivot 96. The end of the pivot arm 94 opposite the lower weld plate 86 is coupled to, and actuated by, an actuator hydraulic cylinder 98. When the cylinder 98 is actuated, a linkage arm 99 pushes on the lever arm 94, causing it to rotate about pivot 96, thereby forcing the other end, coupled to the lower weld plate 86, into proximity with the upper weld plate 84. The strapping material 26 and its opposite end 92 are thereby pinched between the upper and lower weld plates and are in condition for welding.

A friction welded joint is formed in the interface region between the two overlapping ends of the strapping material (26 and 92) by gripping one side of the interface with the upper weld plate 84, while the lower weld plate 86 vibrates, at high frequency, to impart friction heating to the interface region. Friction heating causes the thermoplastic material in the interface region to change its state into a partially liquified form, which then interpenetrates and, when allowed to cool, and solidify, forms a resulting weld joint.

In order to retain the strapping material in position, both the upper and lower weld plates, 84 and 86, have articulations, or teeth, cut in the faces presented to the strapping material in order to prevent the strapping material from displacing with respect to the welding surfaces. The teeth cut in the upper welding plate 84 prevents the upper piece of strap 92 from displacing when welding is occurring. Teeth cut in the surface of the lower welding plate 86 prevents the lower strap 26 from slipping along the face when the welding plate 86 is moved at a high frequency during welding. Welding motion is accomplished by mounting the lever arm 99 on an eccentric pivot pin 96 which is rotated, at a high speed, by a motor (not shown) coupled to the eccentric pivot pin (eccentric crank) by a belt and pulley arrangement. When the eccentric crank is rotated, the lever arm 94 is necessarily displaced back and forth at a vibrational speed equal to the rotational speed of the drive motor. At the same time, hydraulic cylinder 98 supplies a controlled tension to the lever arm 94 which causes the lever arm to apply pressure to the strap interface area while the lever arm causes the lower welding pad 86 to vibrate, imparting sufficient heat to the interface to melt the interface region of the overlapping strap portions.

In certain applications, and when using certain types of thermoplastic strapping material, it might be desirable to release the pressure on the interfacing strap regions as soon as suitable thickness of each strap portion has melted together in the interface region. Necessarily, if pressure is released when the weld joint is still molten, the weld joint must be isolated from any tension or stress to which other parts of the strap may be subjected. In the majority of applications, pressure is maintained on the interface region for a sufficient period of time in order to permit the molten joint portions to cool and at least partially solidify under pressure.

It should further be noted that the bow portion of strapping material 26 disposed within the Chicane 80 is particularly advantageous in promoting high speed friction welding without introducing the danger of tensional stress displacing the strap portion 26 off of the lower weld pad 86. As the weld pad 86 vibrates, it moves a small distance along the extended length of the strapping material. The bow alternately straightens and curls, in response to vibratory motion of the lower weld plate 86, to allow for the motion of the weld plate. The lock 72 remains in place, in order to prevent the strapping material being pulled around the bale from interfering with the welding process. Isolating the weld portion of each strap from that other portion of the strapping material being pulled around the bale, allows for an extremely well controlled welding process because of the relatively complete elimination of elongation stresses in the joint portions of the strap. In addition, the upper weld pad 84 is mounted and floats upon a pin 100 in order to allow for certain small discrepancies in strap thickness and finger assembly tip-to-tip alignment.

In order to further control the welding process, the hydraulic cylinder 98 might be configured to act upon lever arm 94 through a controlled spring, as opposed to a link arm 99. A controlled spring might be constructed with a particular force constant k which would exert a more exact force upon its corresponding end of the lever arm 94 and, thereby translate a more precise pressure upon the interface joint areas of the strap. Additionally, a controlled spring would allow for the spring to be adjusted for specific strap material types and thicknesses, and the hydraulic cylinder 98 could be smaller and consequently less expensive because it would not be required to hold or exert a critical tension.

Figure 16:
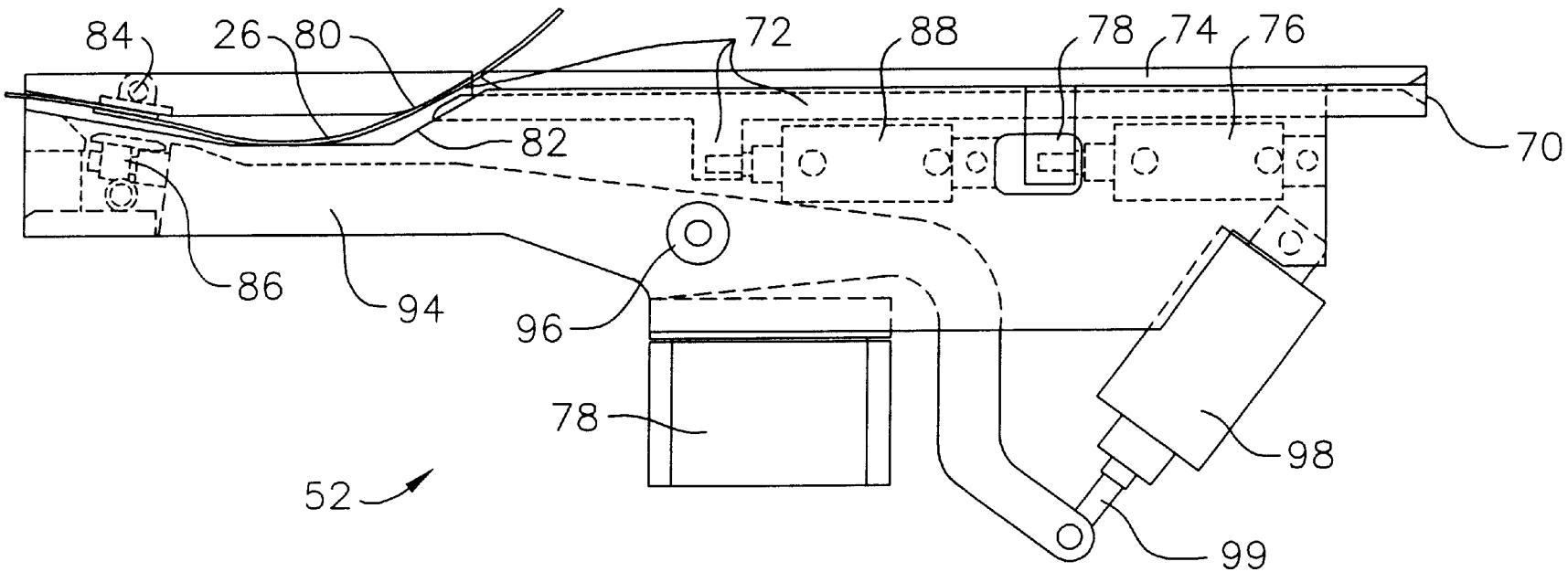
FIG. 16 is a semi-schematic partial cross sectional view of a weld arm finger assembly after weld formation has been completed and the lock retracted, thereby releasing the strap and thus the bale for ejection from the press.

With regard now to FIG. 16, the weld arm finger assembly 52 is depicted in semi-schematic cross-section form at that point in the operation where the weld is substantially complete and the automatic bale tying system is ready to be moved from its tying position back to the loading position as depicted in the exemplary embodiments of FIGS. 4 and 5. As seen in FIG. 16, the lock cylinder 88 has withdrawn the lock assembly 72 from its position proximate to the Chicane surface 80, thereby releasing the strapping material 26. The strap has been welded and cooled, and hydraulic cylinder 98 has retracted the lower welding pad 86, such that the strap is now free to be released from the weld arm finger assembly and the tied bale is ready to be expelled from the press. The system displaces the finger assemblies sideways, releasing the strap from the weld channel, extracts the finger assemblies from the follow block closure cavities and repivots the arm and finger assemblies to the loading position in preparation for tying a next bale.

It will be appreciated that the weld joint in accordance with the present invention is made by imparting a vibratory motion to the interface region of the overlapping strap ends in a longitudinal direction with respect to the straps, as opposed to laterally. Accordingly, joint formation is accommodated over a relatively uniform overlapping interface area over substantially all of the interface. Longitudinal weld formation offers superior joint placement in contrast to lateral weld motion, since in lateral weld motion the edges of the straps are not in continuous registry with one another causing joint formation at the edges to be rather poor. This introduces a particular source of weakness in the overall joint since the joint is formed only in the central portion of the overlapping straps. Joints formed in accordance with the system and method of the present invention are relatively uniform across the entire width of a strap, giving a substantially stronger joint.

In summary, the automatic bale strapping system in accordance with the present invention offers several advantageous features over conventional strapping systems as exemplified by the prior art. In particular, the system according to the invention is able to load strapping material into the apparatus and precut the strap to a specific length while the baling press is still moving to compress a bale. Straps are therefore prepositioned, to either side of the bale, to be wrapped around the bale and welded together as soon as the press ram reaches a predetermined travel limit. The system does not need to wait until the pressing operation is completed before initiating the bale tying process. Since each of the straps have been precut to a specified length, even tension is maintained on each of the straps once they have been securely welded together beneath the bale in a manner described above. Compressed bales are consequently more uniform in size and shape allowing for more efficient bagging, stacking and shipping and a consequent lowering of ginning costs. Further, extruding strapping material from a spool and precutting strapping material after it has been inserted in to the apparatus significantly reduces the waste associated with strap "tails" which are left as a residual appendage after conventional friction welding operations.

A further advantageous feature of the system according to the invention resides in the understanding that both ends of the strap material are protected within their respective finger assemblies, with no portion of the strapping material protruding outside the apparatus such that the tip could be bent or crimped form an inadvertent impact. In particular, the strapper tip support sled both protects its respective strap tip and positions the strap tip for engagement with its opposite number during the welding process. Since the sled is free to slide upon contact with the weld arm finger assembly, no complex equipment nor actuator sequences are required. Indeed, the sled might suitably be controlled by a simple spring disposed within the strapper assembly which extends the sled as the feeder assembly retracts, and allows the sled to retract upon contact force exerted by the weld arm assembly, thereby exposing its respective strap tip.

The baling press profile and system complexity is further minimized by the level arm positioning link system which orients the respective finger assemblies into a horizontal position during their insertion into closure cavities of the follow block. Since the finger assemblies are inserted in a substantially horizontal orientation (substantially parallel to the plane of the follow block) the follow block profile can be lowered in order that the closure cavities have sufficient room to admit the respective arm assemblies and no more. The leveling system further ensures that the weld and strapper finger assemblies are disposed in substantially the same horizontal plane, such that when the tips are in registry with one another the strap ends will overlay one another in the proper manner.

In this regard, the lock and Chicane section of the weld arm finger assembly creates a bowed section in its respective strap end for controlled welding. The strap bow further forces the strap tip in a downwardly direction, thereby allowing the opposing strap tip to pass over its top surface without the danger of end-to-end abutment.

It will be readily observed from the foregoing detailed description and exemplary embodiments of the present invention that numerous variations and modifications may be made without departing from the spirit and scope of the novel concepts or principles described. Because of the considerable variations which may be made by those skilled in the art to the arm assemblies, the finger assemblies, the weld grippers and the specific structure of the weld arm, the present invention is not intended to be limited to the embodiments described above but is intended to embrace all alternatives, variations and equivalents falling within the scope of the invention as defined by the following claims.

What is claimed is:

1. An automatic bale strapping device for mounting on a baling press, the bale strapping device tying thermoplastic straps around a bale formed in the press, the bale strapping device comprising:

first and second arm assemblies pivotally mounted on opposite sides of the baling press for receiving and holding the entire length of a precut baling strap, the first and second arm assemblies pivoting around a compressed bale as the assemblies rotate from a first strap loading position to a second welding position, the first and second arm assemblies including extension means for protecting an otherwise protruding end of the precut baling strap during pivoting, the extension means retracting to thereby expose the end of the precut baling strap during welding.

2. An automatic bale strapping device in accordance with claim 1, further comprising:

a movable follow block mounted on a bale press ram, the follow block forced against the bale by the bale press ram in order to compress the bale in a baling chamber; and closure cavity means, disposed within the follow block for receiving the first and second arm assemblies for welding engagement, wherein a friction weld is formed in an interfacial region of overlapping strap ends, the first and second arm assemblies positioning the weld in a region corresponding to a top or a bottom surface of the bale formed in the press.

3. An automatic bale strapping device in accordance with claim 2, wherein the closure cavity means comprises an elongated, open-ended cavity extending across the length of the follow block, the first arm assembly being inserted into a first end of the cavity as the first assembly is pivoted, and the second arm assembly being inserted into a second, opposite, end of the cavity as the second assembly is pivoted.

4. An automatic bale strapping device in accordance with claim 1, further comprising:

a guide chute disposed along each of the first and second arm assemblies for guiding and retaining a length of bale strapping material; and a feeder assembly removably disposed at one end of the first arm assembly, the feeder assembly introducing a length of bale strapping material into the guide chutes of the arm assemblies, wherein the feeder assembly includes a shear for cutting the strapping to a predetermined length after the strapping is introduced.

5. An automatic bale strapping device in accordance with claim 1, wherein a plurality of first and second arm assemblies are mounted on a respective mounting beam, the arm assemblies spaced-apart from one another so as to apply strapping material to the bale at various locations along a length of the bale.

6. An automatic bale strapping device in accordance with claim 5, further comprising:

a movable follow block mounted on a bale press ram, the follow block forced against the bale by the bale press ram in order to compress the bale in a baling chamber; and wherein each arm assembly further comprises:

a centrally disposed mounting plate, the mounting plate forming a surface of the baling chamber opposite the follow block;

a pivotably movable arm mounted on an outside edge of the mounting plate and capable of being pivoted from a longitudinally extending loading position to a downwardly extending weld position; and a finger assembly mounted on a distal end of the arm, each finger assembly able to be pivoted with respect to the arm from a longitudinally extending loading position to a follow block insertion position, each such finger on the first arm assembly associated with a counterpart finger on the second arm assembly, the strapping device constructed so that when both the arm and the fingers comprising the first and second arm assemblies are in their fully extended loading positions, each strap spans the baling press such that each end of the strap is collocated with an end of a respective finger assembly.

7. An automatic bale strapping device in accordance with claim 6, the extension means comprising a strap tip protection sled, slidably mounted at an outboard end of a corresponding finger assembly, the strap tip protection sled extending to cover an exposed strap tip during a pivoting operation and retracting to expose the strap tip during a welding operation.

8. An automatic bale strapping device in accordance with claim 7, wherein said finger assemblies associated with the second arm assembly each further comprise guide means for guiding a first end of the strap into position in the finger assembly for welding and for guiding a received opposite strap end into overlapping registration with the first end, the guide means including a chicane for bendably displacing the strap first end so as to form a stress relief bow.

9. An automatic bale strapping device in accordance with claim 6, further comprising closure cavity means, disposed within the follow block for receiving the first and second arm assemblies for welding engagement, wherein a friction weld is formed in an interfacial region of overlapping strap ends, the first and second arm assemblies positioning the weld in a region corresponding to a top or a bottom of the bale formed in the press; and further comprising a level arm assembly coupled to between the central mounting plate and each finger assembly, the level arm assembly operatively controlling angular position of each finger assembly with respect to a plane of the follow block, the level arm assembly thereby guiding each finger assembly into the closure cavity means, the level arm assembly rotating each finger assembly to a generally level aspect with respect to the plane of the follow block.

10. An automatic bale strapping device for mounting on a baling press, the bale strapping device tying thermoplastic straps around a bale formed in the press, the bale compressed into a generally rectangular form and having a top, a bottom, two sides and two ends, the bale strapping device comprising:

at least one baling strap precut to a predetermined length, the baling strap having opposite first and second ends;

first and second articulated strap tying assemblies pivotally mounted on opposite sides of a central mounting member of the baling press, the first and second strap tying assemblies disposed in mirror image fashion and in opposition to each other and each having a distal end, the strap tying assemblies receiving and holding the entire length of the baling strap;

first and second finger assemblies, the first finger assembly disposed at the distal end of the first strap tying assembly and the second finger assembly disposed at the distal end of the second strap tying assembly; and wherein, each finger assembly includes a lock, the lock gripping a corresponding end of the baling strap, the first and second strap tying assemblies operatively rotating around a compressed bale so as to direct the baling strap circumferentially around the bale, the strap tying assemblies and finger assemblies in combination articulating to bring the opposite ends of the baling strap into overlying relationship with one another for welding while the press is still forming the bale.

11. An automatic bale strapping device according to claim 10, wherein at least one of the first and second finger assemblies include deployable extension means for protecting an otherwise protruding end of the precut baling strap during pivoting, the extension means retracting to thereby expose the end of the precut baling strap during welding.

12. An automatic bale strapping device according to claim 11, wherein the first and second strap tying and finger assemblies operatively rotate in a downward direction so as to bring the opposite ends of the baling strap into overlying relationship with one another for welding in a region corresponding to the bottom of the formed bale.

13. An automatic bale strapping device according to claim 11, wherein the first and second strap tying and finger assemblies operatively rotate in an upward direction so as to bring the opposite ends of the baling strap into overlying relationship with one another for welding in a region corresponding to the top of the formed bale.

14. A method for tying a plurality of thermoplastic straps around a bale formed in a baling press, the method comprising:

pressing the bale on the baling press, and tying the bale with the thermoplastic straps by using a bale strapping device comprising first and second arm assemblies pivotally mounted on opposite sides of the baling press for receiving and holding the thermoplastic straps, the first and second arm assemblies being rotatable from a first strap loading position to a second welding position, the first and second arm assemblies including extension means for protecting both ends of the thermoplastic straps during pivoting, the extension means on each of the first and second arm assemblies being retractable so that the ends of the thermoplastic straps are exposed during welding, and wherein the thermoplastic straps are substantially of a uniform length.

15. The method as recited in claim 14, further comprising the steps of pressing the bale while concurrently cutting the thermoplastic straps to a predetermined length.

16. The method as recited in claim 14, further comprising the steps of pressing the bale while concurrently rotating the first and second arm assemblies into the welding position.

17. The method as recited in claim 16, wherein the welding position comprises pivoting. the first and second arm assemblies into a receiving channel so that they contact one another.

18. The method as recited in claim 14, wherein the plurality of straps comprises at least 2 straps.

19. The method as recited in claim 18, wherein the first arm assembly comprises a sled for protecting the ends of the thermoplastic straps and wherein the sled is configured to retract when the first and second arm assemblies rotate into the welding position.

20. The method as recited in claim 18, wherein the ends of the thermoplastic straps are welded while the bale is in a compressed state.

21. The method as recited in claim 14, wherein the first and second arm assemblies each comprising a finger assembly and wherein the method further comprising the steps of pivoting the two finger assemblies into a contacting position, and welding the ends of the thermoplastic straps by friction or heat.

22. The method as recited in claim 14, further comprising the steps of:

feeding an uncut strap from a supply source through the first arm assembly, through a plate comprising a feed channel, and through the second arm assembly;

determining the length of the uncut strap to cut with a measuring device or an abutment stop;

cutting the strap at the predetermined length;

repeating the feeding, determining, and cutting steps for at least another strap so that at least two precut thermoplastic straps are available for tying the bale; and performing the feeding, determining, and cutting steps concurrently with the pressing of the bale.

23. The method as recited in claim 14, wherein the ends of the precut thermoplastic straps are rotated so that they are positioned at either the top or bottom of the bale, and not along a compressed side of the bale.

* * * * *